US006271454B1

(12) United States Patent
Tamura

(10) Patent No.: US 6,271,454 B1
(45) **Date of Patent: *Aug. 7, 2001**

(54) METHOD OF CONTROLLING TONE GENERATING DRIVERS BY INTEGRATING DRIVER ON OPERATING SYSTEM

(75) Inventor: Motoichi Tamura, Hamamatsu (JP)

(73) Assignee: Yamaha Corporation, Hamamatsu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/268,211

(22) Filed: Mar. 15, 1999

(30) Foreign Application Priority Data

Mar. 17, 1998 (JP) ..... 10-085106

(51) Int. Cl.[7] ..... G10H 7/00
(52) U.S. Cl. ..... 84/603; 84/659; 84/660
(58) Field of Search ..... 84/603–605, 645, 84/622, 625, 659, 660, DIG. 26

(56) References Cited

U.S. PATENT DOCUMENTS 5,596,159 1/1997 O'Connell .
5,890,017 * 3/1999 Tulkoff et al. ..... 84/645
5,898,118 * 4/1999 Tamura .
5,973,251 * 10/1999 Mukojima et al. ..... 84/603

FOREIGN PATENT DOCUMENTS 0 766 226 9/1996 (EP) .
0 775 996 11/1996 (EP) .

* cited by examiner

*Primary Examiner*—Jeffrey Donels
(74) *Attorney, Agent, or Firm*—Morrison & Foerster

(57) ABSTRACT

A method is designed for controlling a plurality of tone generating drivers by an integrating driver installed in an operating system to generate music tones according to performance data created by a music application software. In the method, the performance data created by the music application software is inputted into the integrating driver through an application program interface provided by the operating system. The performance data is distributed from the integrating driver to one or more of the tone generating drivers provisionally registered to the integrating driver. The registered tone generating driver is operated to generate waveform data of a music tone at a specific sampling frequency based on the distributed performance data. The waveform data is streamed back from the registered tone generating driver to the integrating driver. The specific sampling frequency of the streamed waveform data is converted into a common sampling frequency by the integrating driver. The waveform data of the common sampling frequency is mixed to other waveform data streamed from other tone generating driver while synchronizing progression of the waveform data with progression of other waveform data. The mixed waveform data is reproduced at the common sampling frequency to output the music tones.

27 Claims, 11 Drawing Sheets

FIG.7A
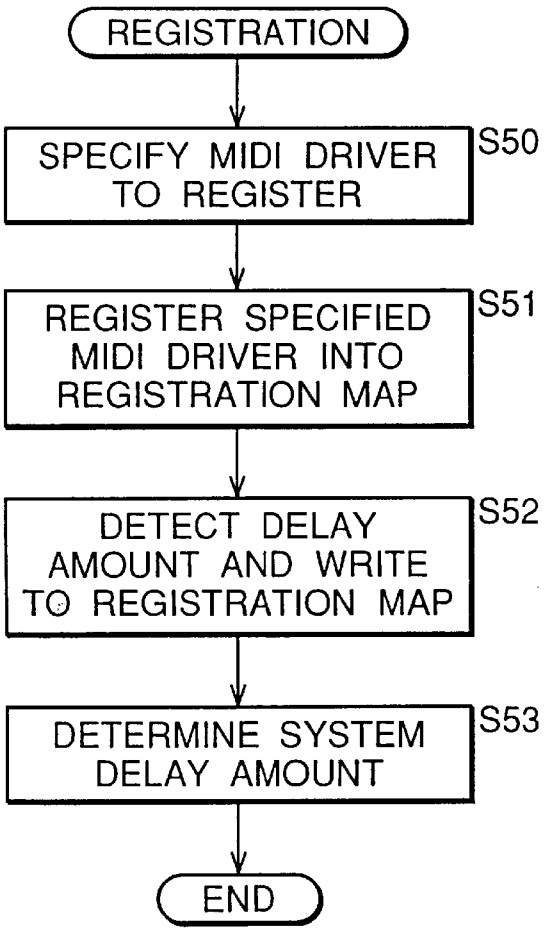
FIG.7B
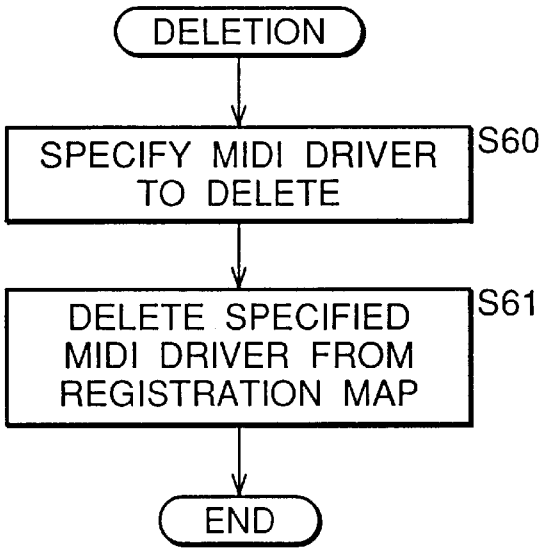
FIG.7C
REGISTRATION MAP
| |
|---|
| NUMBER OF REGISTRATIONS |
| FIRST DRIVER DATA |
| SECOND DRIVER DATA |
| THIRD DRIVER DATA |
| FOURTH DRIVER DATA |
| — |
| — |
| — |

METHOD OF CONTROLLING TONE GENERATING DRIVERS BY INTEGRATING DRIVER ON OPERATING SYSTEM

BACKGROUND OF THE INVENTION

1. Field of the Invention

The present invention generally relates to a method of controlling a plurality of tone generator drivers of different types in an integrated manner, and a machine readable medium storing a control program for a plurality of tone generator drivers.

2. Description of Related Art

Recently, rapid enhancement in the computational capabilities of microprocessors (or CPUs) has been increasingly finding their applications in general-purpose computers and tone generators. Execution of a tone generating program or module on these general-purpose computers has realized systems for generating tone waveform data. On the other hand, generation of tone waveform data by means of a dedicated hardware device having a circuit configuration adapted to the tone generation is practiced conventionally.

FIG. 13 shows a software configuration used in a conventional tone generating system supported by computer software. An operating system (OS) 101 for this tone generating system is Windows 95 (trademark of Microsoft Corporation) for example. The OS 101 has an interface IF1 (MIDI-Out API) and an interface IF2 (MIDI-Out API) that transfer MIDI (Musical Instrument Digital Interface) messages representing performance information for generating tone waveform data, and an interface IF3 (WAVE-Out API) that transfers generated tone waveform data.

In the example shown, the interface IF1 (MIDI-Out API) is used as an interface for a software tone generator adapted to generate tone waveform data by having a CPU (central processing unit) execute a predetermined tone generating program. The interface IF2 (MIDI-Out API) is used for a hardware tone generator adapted to generate tone waveform data by means of a dedicated hardware device having a circuit configuration suitable for a particular tone generating scheme.

Music application software 100 for generating a MIDI message is located in the application layer for generating performance information in the form of a MIDI message in a real-time manner. A second MIDI driver (a hardware tone generator) and a third MIDI driver (a software tone generator) are installed on the OS 101. The second MIDI driver supplies control data based on the MIDI message to an external hardware tone generator 103. The third MIDI driver is a kind of an application software.

In the example shown in FIG. 13, the MIDI message generated by the music application software 100 is received by the third MIDI driver through the interface IF1 (MIDI-Out API) provided on the OS 101. Having received the MIDI message, the third MIDI driver generates the tone waveform data based on the received MIDI message and supplies through the interface IF3 (WAVE-Out API) the generated tone waveform data to a first WAVE driver installed on the OS 101. The first WAVE driver reads through a direct memory access (DMA) controller the tone waveform data stored in a buffer memory, and supplies the read data to a CODEC (COder/DECoder) 105, which is an external hardware device. The CODEC 105 converts the tone waveform data into an analog tone signal, which is then sounded from a sound system not shown.

The third MIDI driver computes tone waveform data a sample by sample within one frame period, thereby generating one frame of the tone waveform data. The generated tone waveform data is stored in a buffer memory. The third MIDI driver generates one frame of tone waveform data while controlling a delay time of the computation for data generation and controlling an amount of tone waveform data generated in a unit time. A subroutine library 102 of the third MIDI driver stores general-purpose modules (or subroutines) for use in the computation for generating tone waveform data such as a digital filter, an interpolator, and a mixer. By use of these general-purpose modules, the third MIDI driver generates tone waveform data having required musical properties such as pitch and timbre.

In the conventional computer-based tone generating system as shown in FIG. 13, a MIDI message generated by the music application software 100 is received by the third MIDI driver through the interface IF1 (MIDI-Out API) provided in the OS 101. Alternatively, the tone generating system may be programmed so that a MIDI message generated by the music application software 100 is received by the second MIDI driver through the other interface IF2 (MIDI-Out API) provided in the OS 101. In this case, the second MIDI driver supplies the tone control data based on the received MIDI message to the external hardware tone generator 103, in which a tone waveform is generated based on the tone control data and the generated tone waveform is sounded.

However, the above-mentioned conventional tone generating system presents a problem that, because this system can set up a MIDI driver only before starting music performance, this system cannot dynamically change MIDI drivers during the music performance. Therefore, the conventional tone generating system cannot generate tone waveform data for different performance parts by use of different tone generators in the sounding of the generated tone waveform data.

Another problem involved in the conventional tone generating system is that a MIDI driver not installed on the operating system cannot be used. Newly installing a MIDI driver onto the operation system requires cumbersome operations such as rebooting the system.

Generating tones by use of a software tone generator requires a WAVE driver. If a plurality of MIDI drivers each constituted by a software tone generator are used, a plurality of WAVE drivers are required, presenting a problem of shortage of WAVE drivers during the music performance. It is not possible for the conventional system to open a new WAVE driver even when the system suffers from the shortage of the existing WAVE driver. Further, in the case where a plurality of MIDI drivers each constituted by a software tone generator are used, the conventional tone generating system does not consider control on relative delay times caused in computing process of the generation of tone waveform data among the plurality of the tone generators, nor does consider on variation of the amount of tone waveform data generated in a unit time among the plurality of the tone generators.

SUMMARY OF THE INVENTION

It is therefore an object of the present invention to provide a method of controlling a plurality of tone generating drivers, the method being capable of using MIDI drivers without installing the same on the operating system and being capable of dynamically switching the installed MIDI drivers during the music performance. It is another object of the present invention to provide a method of controlling a plurality of tone generating drivers, the method being capable of using no more than one WAVE driver even if a plurality of MIDI drivers are used and being capable of eliminating the necessity for executing time control on tone waveform data for each MIDI driver. It is a further object of the present invention to provide a control method capable of integrating a plurality of tone generating drivers for organized control thereof.

In order to achieve the objects, in a fist aspect of the invention, a method is designed for controlling a plurality of tone generating drivers by an integrating driver installed in an operating system to generate music tones according to performance data created by a music application software. The inventive method comprises the steps of inputting the performance data created by the music application software to the integrating driver through an application program interface provided by the operating system, distributing the performance data from the integrating driver to one or more of the tone generating drivers provisionally registered to the integrating driver, operating the registered tone generating driver to generate waveform data of a music tone at a specific sampling frequency based on the distributed performance data, streaming the waveform data from the registered tone generating driver to the integrating driver, converting the specific sampling frequency of the streamed waveform data into a common sampling frequency by the integrating driver, mixing the waveform data of the common sampling frequency to other waveform data streamed from other tone generating driver while synchronizing progression of the waveform data with progression of other waveform data, and reproducing the mixed waveform data at the common sampling frequency to output the music tones. By such a method, the system can freely add and delete tone generating drivers having different sampling frequencies of the tone waveform data. Further, it is not necessary to increase a number of application program interfaces of the operating system for feeding the performance data to the tone generating drivers even if another tone generating driver is added.

Preferably, in the first aspect, the step of reproducing comprises feeding the mixed waveform data through another application program interface provided by the operating system to a wave driver installed in the operating system for reproducing the mixed waveform data at the common sampling frequency. By such a method, it is not necessary to increase a number of application program interfaces for feeding the waveform data to the WAVE driver even if a tone generating driver is added since the common interface provided by the operating system is used for transferring the waveform data generated by any tone generating drivers to the WAVE driver.

In a second aspect of the invention, a method is designed for controlling a plurality of tone generator modules by an integrator module for generating music tones according to performance data being created by a music application software and being composed of a plurality of timbre parts. The inventive method comprises the steps of registering a plurality of tone generator modules for control by the integrator module such that each registered tone generator module is operable under control by the integrator module to generate waveform data of a music tone in accordance with the performance data, allocating the timbre parts of the performance data to the registered tone generator modules to establish correspondence between each timbre part and each tone generator module, distributing each timbre part of the performance data from the integrator module to each tone generator module in accordance with the established correspondence so as to operate the plurality of the tone generator modules concurrently with each other to generate a plurality of waveform data representing a plurality of music tones corresponding to the plurality of the timbre parts, and mixing the plurality of the waveform data with each other to output the music tones in accordance with the performance data. By such a method, the inventive system can dynamically allocate the timbre parts of the inputted performance data to the registered tone generating modules.

In a third aspect of the invention, a method is designed for controlling a plurality of tone generator modules by an integrator module for generating music tones according to performance data being created by a music application software and being composed of a plurality of performance parts. The inventive method comprises the steps of registering a plurality of tone generator modules for control by the integrator module such that each registered tone generator module can carry out a task of processing the performance data to generate waveform data under control by the integrator module, probing each tone generator module to detect a time lag of the task from an input timing of the performance data to an output timing of the waveform data, allocating the performance parts of the performance data to the tone generator modules to establish correspondence between each performance part and each tone generator module, delivering each performance part of the performance data from the integrator module to each tone generator module in accordance with the established correspondence at a variable input timing, adjusting the input timings of the performance parts of the performance data so as to compensate for the detected time lags among the tone generator modules, thereby synchronizing the output timings of the waveform data from the tone generator modules, and mixing the waveform data generated by the plurality of the tone generator modules to produce the music tones. By such a method, the inventive system can synchronously reproduce the tone waveform data generated by the tone generator modules having different processing speeds by adjusting the input timings of the waveform data to the respective tone generator modules.

In a fourth aspect of the invention, a method is designed for controlling a plurality of tone generator modules by an integrator module on an operating system to generate music tones in accordance with performance data being created by a music application software and being composed of parts. The inventive method comprises the steps of feeding the performance data created by the music application software to the integrator module through an application program interface provided by the operating system, registering a plurality of tone generator modules for control by the integrator module, each tone generator module being executable on the operating system to generate waveform data of a music tone according to the performance data, opening an individual interface dedicated to each of the registered tone generator modules for communication with the integrator module, allocating the performance data to the tone generator modules a part by part, delivering each allocated part of the performance data from the integrator module to each tone generator module through the individual interface dedicated to each tone generator module so as to generate the waveform data, and collecting the waveform data generated by the registered tone generator modules to the integrator module and mixing the collected waveform data to generate the music tones. By such a method, the interfaces are flexibly opened in correspondence to the registered tone generator modules, hence a number of the registered tone generator modules or tone generating programs can be freely changed.

Preferably, in the fourth aspect, the step of registering comprises registering the tone generator modules including a standard tone generator module and a non-standard tone generator module, the step of opening comprises opening a first individual interface provided by the integrator module independently from the operating system for the standard tone generator module and opening a second individual interface provided by the operating system for the non-standard tone generator module, and the step of delivering comprises delivering the performance data to the standard tone generator module through the first individual interface and delivering the performance data to the non-standard tone generator module through the second individual interface. By such a method, the system can conduct a joint performance by the standard and non-standard ones of the tone generator modules through the integrator module. The integrator module can provide interfaces to the tone generator modules if they are designed in agreement with the standard of the integrator module without using interfaces provided by the operating system, thereby avoiding shortage of the application program interfaces.

In a fifth aspect of the invention, a method is designed for controlling a plurality of tone generator modules by an integrator module on an operating system for generating music tones according to performance data being created by a music application software and being composed of parts. The inventive method comprises the steps of feeding the performance data created by the music application software to the integrator module through an application program interface provided by the operating system, registering a plurality of tone generator modules for control by the integrator module, each tone generator module being executable on the operating system to generate waveform data of a music tone according to the performance data, opening a data stream path between the integrator module and each of the registered tone generator modules, allocating the performance data to the registered tone generator modules a part by part, delivering each allocated part of the performance data from the integrator module to each tone generator module so as to enable each tone generator module to generate the waveform data, and collecting the waveform data generated by each tone generator module to the integrator module through each data stream path and mixing the collected waveform data to generate the music tones. By such a method, the integrator module opens the individual data stream paths to the registered tone generator modules, hence it is possible to freely increase or decrease the number of the registered tone generator modules.

Preferably, in the fifth aspect, the step of registering comprises registering the tone generator modules including a standard tone generator module and a non-standard tone generator module, the step of opening comprises opening one data stream path provided by the integrator module independently from the operating system for the standard tone generator module and opening another data stream path in the form of an interface provided by the operating system for the non-standard tone generator module, and the step of collecting comprises collecting the waveform data from the standard tone generator module through said one data stream path and collecting the waveform data from the non-standard tone generator module through said another data stream path. By such a method, the inventive system can conduct a joint performance by the standard and non-standard ones of the tone generator modules through the integrator module. The integrator module can provide stream paths of the waveform data between the integrator module and the respective tone generator modules if they are designed in agreement with the standard of the integrator module without using interfaces provided by the operating system, thereby avoiding shortage of the application program interfaces.

In a sixth aspect of the invention, a method is designed for controlling a plurality of tone generator modules by an integrator module on an operating system for generating music tones according to performance data being created by a music application software and being composed of parts. The inventive method comprises the steps of feeding the performance data created by the music application software to the integrator module through an application program interface provided by the operating system, registering a plurality of tone generator modules for control by the integrator module, allocating the performance data a part by part to the registered tone generator modules and delivering each allocated part of the performance data to each corresponding tone generator modules from the integrator module, applying triggers individually to the tone generator modules to cause the tone generator modules to progressively generate waveform data corresponding to the allocated parts of the performance data in response to the triggers, collecting the waveform data generated by the tone generator modules to the integrator module and mixing the collected waveform data to output the music tones, monitoring progressions in the generation of the waveform data by the tone generator modules to discriminate between lagging one and advancing one of the tone generator modules, and controlling application of the triggers to balance the progression of the generation of the waveform data among the lagging tone generator module and the advancing tone generator module. By such a method, the integrator module manages operation states of all the tone generator modules to thereby balance the tone generator modules.

BRIEF DESCRIPTION OF THE DRAWINGS

These and other objects of the invention will be seen by reference to the description, taken in connection with the accompanying drawings, in which:

FIG. 7A is a flowchart indicative of MIDI driver registration processing;

FIG. 7B is a flowchart indicative of MIDI driver deletion processing;

FIG. 7C is a diagram illustrating a registration map;

DETAILED DESCRIPTION OF PREFERRED EMBODIMENTS

This invention will be described in further detail by way of example with reference to the accompanying drawings.

Figure 1:
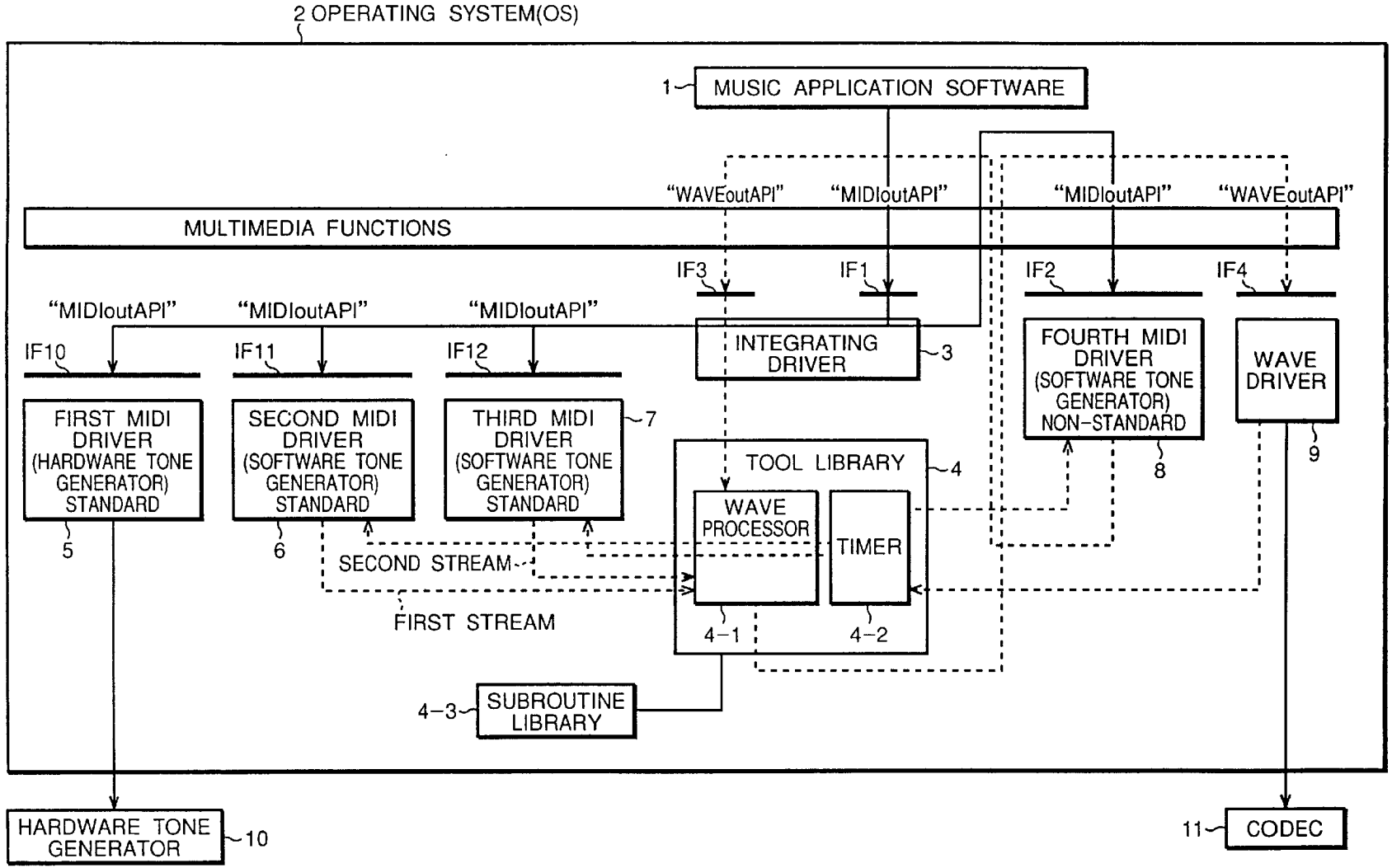
FIG. 1 is a block diagram illustrating a software structure adopted by a method of controlling a plurality of tone generating drivers according to the invention.

Now, referring to FIG. 1, an operating system (OS) 2 is Windows 95 (trademark of Microsoft Corporation) for example in this software structure. The OS 2 has an application program interface IF1 (MIDI-Out API) and an application program interface IF2 (MIDI-Out API) capable of transferring a MIDI (Musical Instrument Digital Interface) message, which is performance information for generating tone waveform data. The operating system 2 has also an application program interface IF3 (WAVE-Out API) and an application program interface IF4 (WAVE-Out API) capable of transferring generated tone waveform data.

Music application software 1 for generating MIDI messages is located at the application layer on the operating system, for sequentially generating performance information in the form of MIDI messages in a real-time fashion. The generated MIDI messages are received by an integrating driver 3 that is a kind of program or software module characteristic to the invention through the interface IF1 (MIDI-Out API) provided as one of multimedia functions of the OS 2. Installation of the integrating driver 3 on the OS 2 provides the operating system with the capabilities of the interface IF1 and the interface IF3. Stated otherwise, the operating system opens the interfaces IF1 and IF3 when the integrating driver 3 is installed in the operating system. The MIDI messages received by the integrating driver 3 are allocated a part by part and distributed to a first MIDI driver 5 (hardware tone generator), a second MIDI driver 6 (software tone generator), a third MIDI driver 7 (software tone generator), which are all standardized in agreement with the standard of the integrating driver, as well as to a non-standard fourth MIDI driver 8 (software tone generator) which is not agreement with the standard of the integrating driver.

According to the invention, a method is designed for controlling a plurality of tone generator modules in the form of MIDI drivers 5–8 by an integrator module in the form of integrating driver 3 for generating music tones according to performance data being created by a music application software 1 and being composed of a plurality of timbre parts. The inventive method comprises the steps of registering a plurality of tone generator modules 5–8 for control by the integrator module 3 such that each registered tone generator module 5–8 is operable under control by the integrator module 3 to generate waveform data of a music tone in accordance with the performance data, allocating the timbre parts of the performance data to the registered tone generator modules 5–8 to establish correspondence between each timbre part and each tone generator module, distributing each timbre part of the performance data from the integrator module 3 to each tone generator module 5–8 in accordance with the established correspondence so as to operate the plurality of the tone generator modules 5–8 concurrently with each other to generate a plurality of waveform data representing a plurality of music tones corresponding to the plurality of the timbre parts, and mixing the plurality of the waveform data with each other to output the music tones in accordance with the performance data. By such a method, the inventive system can dynamically allocate the timbre parts of the inputted performance data to the registered tone generating modules 5–8.

The standard MIDI drivers 5 through 7 can be registered into the integrating driver 3 so that the integrating driver 3 opens an interface IF10 (MIDI-Out API), an interface IF11 (MIDI-Out API), and an interface IF12 (MIDI-Out API). Through these interfaces IF10 (MIDI-Out API), IF11 (MIDI-Out API), and IF12 (MIDI-Out API), the allocated MIDI messages are distributed to the standard first MIDI driver 5 (hardware tone generator), second MIDI driver 6 (software tone generator), and third MIDI driver 7 (software tone generator). To the non-standard fourth MIDI driver 8 (software tone generator), the allocated MIDI message is supplied through the interface IF2 (MIDI-Out API) provided by the OS 2 when installing this driver 4.

According to the invention, a method is designed for controlling a plurality of tone generator modules 5–8 by an integrator module 3 on an operating system 2 to generate music tones in accordance with performance data being created by a music application software 1 and being composed of parts. The inventive method comprises the steps of feeding the performance data created by the music application software 1 to the integrator module 3 through an application program interface IF1 provided by the operating system 2, registering a plurality of tone generator modules 5–8 for control by the integrator module 3, each tone generator module being executable on the operating system 2 to generate waveform data of a music tone according to the performance data, opening an individual interface IF10–IF12 and IF2 dedicated to each of the registered tone generator modules 5–8 for communication with each tone generator module module, allocating the performance data to the tone generator modules 5–8 a part by part, delivering each allocated part of the performance data from the integrator module 3 to each tone generator module 5–8 through the individual interface IF10–IF12 and IF2 dedicated to each tone generator module so as to generate the waveform data, and collecting the waveform data generated by the registered tone generator modules 6–8 to the integrator module 3 and mixing the collected waveform data to generate the music tones. By such a method, the interfaces IF10–IF12 and IF2 are flexibly opened in correspondence to the registered tone generator modules 5–8, hence a number of the registered tone generator modules 5–8 or tone generating programs can be freely changed.

Preferably, the step of registering comprises registering the tone generator modules 5–8 including a standard tone generator module 5–7 and a non-standard tone generator module 8, the step of opening comprises opening a first individual interface IF10–IF12 provided by the integrator module 3 independently from the operating system 2 for the standard tone generator module 5–7 and opening a second individual interface IF2 provided by the operating system 2 for the non-standard tone generator module 8, and the step of delivering comprises delivering the performance data to the standard tone generator module 5–7 through the first individual interface IF10–IF12 and delivering the performance data to the non-standard tone generator module 8 through the second individual interface IF2. By such a method, the system can conduct a joint performance by the standard and non-standard ones of the tone generator modules 5–8 through the integrator module 3. The integrator module 3 can provide interfaces IF10–IF12 to the tone generator modules 5–7 if they are designed in agreement with the standard of the integrator module 3 without using interfaces IF1–IF4 provided by the operating system 2, thereby avoiding shortage of the application program interfaces.

The non-standard fourth MIDI driver 8 (software tone generator) must be installed on the OS 2 for use. On the other hand, the standard first MIDI driver 5 (hardware tone generator), second MIDI driver 6 (software tone generator), and third MIDI driver 7 (software tone generator) may be installed on the OS 2 for use or may be registered in the integrating driver 3 for use without installation on the OS 2. If the standard MIDI drivers are registered in the integrating driver 3 for use, these MIDI drivers can be immediately used without restarting or rebooting the OS 2. Therefore, no cumbersome installing operations are required. The first MIDI driver 5 is designed to drive a hardware tone generator 10 and controls the tone generating operation of the hardware tone generator 10 based on the MIDI message supplied through the interface F10. The second MIDI driver 6 (software tone generator) and the third MIDI driver 7 (software tone generator) are each constituted by a software tone generator module.

The MIDI message is supplied from the integrating driver 3 to the second MIDI driver 6 (software tone generator) and the third MIDI driver 7 (software tone generator) through the interface IF11 (MIDI-Out API) and the interface IF12 (MIDI-Out API), respectively. The second MIDI driver 6 (software tone generator) and the third MIDI driver 7 (software tone generator) receive a trigger generated at a predetermined period from a timer 4-2 in a tool library 4 provided in the integrating driver 3, and execute necessary computation for generating a predetermined amount of tone waveform data. The tone waveform data generated by the second MIDI driver 6 (software tone generator) is supplied to a WAVE processor 4-1 in the tool library 4 through a first stream path. The tone waveform data generated by the third MIDI driver 7 (software tone generator) is supplied to the WAVE processor 4-1 through a second stream path. The non-standard fourth MIDI driver 8 (software tone generator) executes tone generating computation by use of the MIDI message supplied through the interface IF2. The tone waveform data generated by the fourth MIDI driver 8 (software tone generator) is supplied to the WAVE processor 4-1 through the interface IF3 (WAVE-Out API).

According to the invention, a method is designed for controlling a plurality of tone generator modules 5–8 by an integrator module 3 on an operating system 2 for generating music tones according to performance data being created by a music application software 1 and being composed of parts. The inventive method comprises the steps of feeding the performance data created by the music application software 1 to the integrator module 3 through an application program interface IF1 provided by the operating system 2, registering a plurality of tone generator modules 5–8 for control by the integrator module 3, each tone generator module being executable on the operating system 2 to generate waveform data of a music tone according to the performance data, opening a data stream path between the integrator module 3 and each of the registered tone generator modules 6–8, allocating the performance data to the registered tone generator modules 5–8 a part by part, delivering each allocated part of the performance data from the integrator module 3 to each tone generator module so as to enable each tone generator module to generate the waveform data, and collecting the waveform data generated by each tone generator module to the integrator module through each data stream path and mixing the collected waveform data to generate the music tones. By such a method, the integrator module 3 opens the individual data stream paths to the registered tone generator modules 6–8, hence it is possible to freely increase or decrease the number of the registered tone generator modules.

Preferably, the step of registering comprises registering the tone generator modules including a standard tone generator module 6 and 7 and a non-standard tone generator module 8, the step of opening comprises opening a data stream path provided by the integrator module 3 independently from the operating system 2 for the standard tone generator module 6 or 7 and opening another data stream path in the form of an interface IF3 provided by the operating system 2 for the non-standard tone generator module 8, and the step of collecting comprises collecting the waveform data from the standard tone generator module 6 and 7 through the data stream path and collecting the waveform data from the non-standard tone generator module 8 through the interface IF3. By such a method, the inventive system can conduct a joint performance by the standard and non-standard ones of the tone generator modules 6–8 through the integrator module 3. The integrator module 3 can provide stream paths of the waveform data between the integrator module 3 and the respective tone generator modules 6 and 7 if they are designed in agreement with the standard of the integrator module 3 without using interfaces IF1–IF4 provided by the operating system 2, thereby avoiding shortage of the application program interfaces.

The WAVE processor 4-1 converts a specific sampling frequency Fs of the received tone waveform data into a predetermined common sampling frequency. If plural pieces of tone waveform data have been received, the WAVE processor 4-1 adds together the pieces of tone waveform data matched in timing. It should be noted that, if some of the plurality of received tone waveform data have a common sampling frequency Fs, such pieces of tone waveform data may be added together before the sampling frequency conversion, thereby decreasing the amount of computation. When the amount of the added tone waveform data has reached one frame, one frame of tone waveform data is stored in a buffer memory for reservation in the WAVE driver 9 for reproduction. In this case, the tone waveform data is supplied from the WAVE processor 4-1 to the WAVE driver 9 through the interface IF4 (WAVE-Out API). Consequently, if two or more MIDI drivers are used, only one WAVE driver may be used, thereby preventing a situation in which WAVE drivers run short.

According to the invention, a method is designed for controlling a plurality of tone generating drivers 5–8 by an integrating driver 3 installed in an operating system 2 to generate music tones according to performance data created by a music application software 1. The inventive method comprises the steps of inputting the performance data created by the music application software 1 to the integrating driver 3 through an application program interface IF1 provided by the operating system 2, distributing the performance data from the integrating driver 3 to one or more of the tone generating drivers 6 and 7 provisionally registered to the integrating driver 3, operating the registered tone generating driver 6 to generate waveform data of a music tone at a specific sampling frequency based on the distributed performance data, streaming the waveform data from the registered tone generating driver 6 to a WAVE processor 4-1 contained in the tool library 4 of the integrating driver 3, converting the specific sampling frequency of the streamed waveform data into a common sampling frequency by the WAVE processor 4-1 of the integrating driver 3, mixing the waveform data of the common sampling frequency to other waveform data streamed from other tone generating driver 8 while synchronizing progression of the waveform data with progression of other waveform data, and reproducing the mixed waveform data at the common sampling frequency to output the music tones. By such a method, the system can freely add and delete tone generating drivers 5–8 having different sampling frequencies of the tone waveform data. Further, it is not necessary to increase a number of application program interfaces of the operating system 2 for feeding the performance data to the tone generating drivers even if another tone generating driver is added.

Preferably, the step of reproducing comprises feeding the mixed waveform data through another application program interface IF4 provided by the operating system 2 to a WAVE driver 9 installed in the operating system 2 for reproducing the mixed waveform data at the common sampling frequency. By such a method, it is not necessary to increase a number of application program interfaces for feeding the waveform data to the WAVE driver 9 even if a tone generating driver is added since the common interface IF4 provided by the operating system 2 is used for transferring the waveform data generated by any tone generating drivers 6–8 to the WAVE driver 9.

The integrating driver 3 checks the progress of the tone waveform data received from the first and second stream paths while controlling the delay time of the computation for the tone waveform generation and the amount of tone waveform data generated in a unit time, thereby controlling the priority of triggers caused by the timer 4-2. The priority may also be determined according to the computation delay time until the tone waveform data is generated in each MIDI driver. It should be noted that the tool library 4 is provided as a dynamic link library (DLL). Various sub modules stored in the DLL can be called when the integrating driver 3 is started.

According to the invention, a method is designed for controlling a plurality of tone generator modules 5–8 by an integrator module 3 on an operating system 2 for generating music tones according to performance data being created by a music application software 1 and being composed of parts. The inventive method comprises the steps of feeding the performance data created by the music application software 1 to the integrator module 3 through an application program interface IF1 provided by the operating system 2, registering a plurality of tone generator modules 5–8 for control by the integrator module 3, allocating the performance data a part by part to the registered tone generator modules 5–8 and delivering each allocated part of the performance data to each corresponding tone generator modules 5–8 from the integrator module 3, applying triggers by a timer 4-2 contained in a tool library 4 of the integrator module 3 individually to the tone generator modules 6–8 to cause the tone generator modules 6–8 to progressively generate waveform data corresponding to the allocated parts of the performance data in response to the triggers, collecting the waveform data generated by the tone generator modules 6–8 to the integrator module 3 and mixing the collected waveform data to output the music tones, monitoring progressions in the generation of the waveform data by the tone generator modules 6–8 to discriminate between lagging one and advancing one of the tone generator modules 6–8, and controlling application of the triggers by the timer 4-2 to balance the progression of the generation of the waveform data among the lagging tone generator module and the advancing tone generator module. By such a method, the integrator module 3 manages operation states of all the tone generator modules 6–8 to thereby balance the tone generator modules 6–8.

The tone waveform data generated in the standard second and third MIDI drivers 6 (software tone generator) and 7 (software tone generator) is supplied to the WAVE processor 4-1 through the first and second stream paths only in the amount of data generated in response to a trigger. The time control on the tone waveform data is not executed in the second MIDI driver 6 (software tone generator) and the third MIDI driver 7 (software tone generator). On the other hand, in the non-standard fourth MIDI driver 8 (software tone generator), time control is executed on the generated tone waveform data. Therefore, when one frame of tone waveform data has been generated, the generated data is supplied to the WAVE processor 4-1. This allows the standard MIDI drivers to execute time control on the tone waveform data in a unified manner in the WAVE processor 4-1. Consequently, each MIDI driver need not execute time control separately and, the integrating driver 3 can execute optimum control on two or more concurrently operating MIDI drivers.

According to the invention, a method is designed for controlling a plurality of tone generator modules 5–8 by an integrator module 3 for generating music tones according to performance data being created by a music application software 1 and being composed of a plurality of performance parts. The inventive method comprises the steps of registering a plurality of tone generator modules 5–8 for control by the integrator module 3 such that each registered tone generator module can carry out a task of processing the performance data to generate waveform data under control by the integrator module 3, probing each tone generator module to detect a time lag of the task from an input timing of the performance data to an output timing of the waveform data, allocating the performance parts of the performance data to the tone generator modules 5–8 to establish correspondence between each performance part and each tone generator module, delivering each performance part of the performance data from the integrator module 3 to each of the tone generator modules 5–8 in accordance with the established correspondence at a variable input timing, adjusting the input timings of the performance parts of the performance data so as to compensate for the detected time lags among the tone generator modules 5–8, thereby synchronizing the output timings of the waveform data from the tone generator modules 5–8, and mixing the waveform data generated by the plurality of the tone generator modules 6–8 to produce the music tones. By such a method, the inventive system can synchronously reproduce the tone waveform data generated by the tone generator modules 5–8 having different processing speeds by adjusting the input timings of the waveform data to the respective tone generator modules 5–8.

When the music application software 1, which is an application program, issues a request to open a MIDI driver registered in the integrating driver 3, such a request is detected and a corresponding stream path, the first stream path or the second stream path, is opened. The first and second stream paths are channels capable of transmitting tone waveform data at a specified rate and in a specified bit width. Priorities are selectively given to these streams. In the WAVE processor 4-1, the received tone waveform data is processed in the order of the priorities. Preferably, the priority is determined according to the significance of the performance part to which the tone generating driver is assigned.

The WAVE driver 9 for which reproduction of tone waveform data has been reserved by the WAVE processor 4-1 reads samples of the waveform data from the buffer memory through a direct memory access (DMA) controller so that the reproduced data is outputted for every sampling period, and supplies the samples of the waveform data thus read to a CODEC 11. The CODEC 11 converts the waveform data samples into an analog tone signal, which is then sounded from a sound system not shown. Waveform sample data generated in the hardware tone generator 10 is also sounded from the sound system not shown.

A subroutine library 4-3 provided in the integrated tool library 4 is generalized and stores general-purpose sub modules (or subroutines) for use in computation of generating tone waveform data, such as a digital filter, an interpolator, and a mixer. Each standard MIDI driver uses these general-purpose sub modules to generate tone waveform data having required musical properties such as pitch and timbre. In the above-mentioned software structure, it is assumed that the second MIDI driver 6 (software tone generator) be a physical model tone generator simulating an acoustic musical instrument and the third MIDI driver 7 (software tone generator) be a waveform memory tone generator. In such a case, it is preferable to distribute a MIDI message corresponding to a solo part to the second MIDI driver 6 (software tone generator) and a MIDI message corresponding to an accompaniment part to the third MIDI driver 7 (software tone generator).

The standard MIDI drivers may be used by registering the same into the integrating driver 3 without installing them on the OS 2 as drivers. Because the integrating driver 3 is adapted to distribute MIDI messages to the MIDI drivers, they can be supervised to exchange the performance parts during the music performance. Consequently, different portions of the same part can be performed by different MIDI drivers, thereby widening performance diversity.

Figure 2:
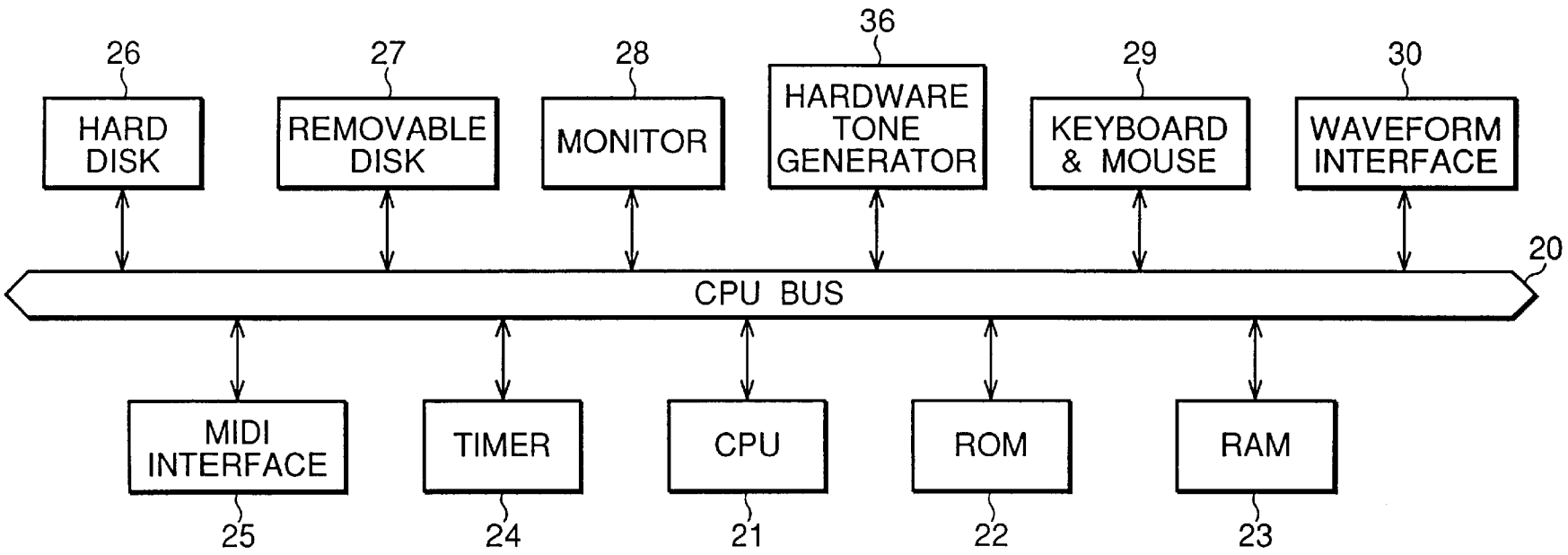
FIG. 2 a block diagram illustrating a hardware configuration for use in a preferred embodiment of a method of controlling a plurality of software-based tone generating drivers according to the invention.

The following describes a hardware configuration of the music apparatus practiced as one preferred embodiment of the invention with reference to FIG. 2. In the figure, reference numeral 21 denotes a microprocessor or central processing unit (CPU) for use as a main controller of the embodiment. Under the control of the CPU 21, the method of controlling a plurality of tone generating drivers is executed as a process for controlling a plurality of drivers by an instruction program for controlling a plurality of drivers. At the same time, processing of other application programs is executed. Reference numeral 22 denotes a read-only memory (ROM) storing the control program and other programs to be executed by the CPU 21. Reference numeral 23 denotes a random access memory (RAM) providing a work area to be used by the CPU 21 and an area in which a program and performance data for example read from a hard disk 26 or a removable disk 27, which are external storage devices, are loaded. Reference numeral 24 is a hardware timer for providing the CPU 21 with the timing of timer interrupt processing.

Reference numeral 25 is a MIDI interface in which performance data such as MIDI messages are inputted from other MIDI devices, and from which internally generated MIDI messages are supplied to those external MIDI devices. Reference numeral 26 denotes the hard disk for storing application software and MIDI performance data. Reference numeral 27 denotes the removable disk for storing application software and MIDI performance data like the hard disk 26. Reference numeral 28 is a monitor on which the screen of an application program or various settings is displayed. Reference numeral 29 denotes a personal computer keyboard having alphanumeric, symbolic, and control keys. This keyboard device includes a pointing device such as a so-called mouse.

Reference numeral 30 denotes a waveform interface for reading tone waveform data from the RAM 3 at a sampling frequency and for converting the tone waveform data into an analog signal, which is sounded from a sound system not shown. It should be noted that the sound system may have an effect imparting circuit for imparting effects such as reverberation and chorus to the tone signal supplied from the waveform interface 30. Reference numeral 36 denotes a hardware tone generator dedicated to tone generation. This hardware tone generator executes a plurality of time-division channel operations as instructed by the CPU 21, thereby generating and outputting a plurality of tones. It should be noted that the above-mentioned hardware circuits are interconnected through a CPU bus 20. The above-mentioned configuration is generally the same as those of a personal computer and a workstation. Therefore, the control method associated with the present invention can be implemented by a general-purpose computer.

The above-mentioned hardware configuration may also have a communication interface for connection with a server computer through a communication network such as a LAN (Local Area Network), the Internet, or a telephone network. In addition, the control program for a plurality of tone generating drivers may be installed on the hard disk 26 or the removable disk 27 by setting a machine readable medium such as a floppy disc (FDD) or compact-disc ROM (CD-ROM) storing the control program into a drive attached as an external storage device, thereby allowing the above-mentioned hardware configuration to perform the process of controlling a plurality of tone generating drivers. The machine readable medium is used in a music apparatus having a processor or CPU for operating an integrator module and a plurality of tone generator modules on an operating system. The machine readable medium contains program instructions executable by the processor to cause the music apparatus to perform a process of generating music tones according to performance data created by a music application software.

Figure 3:
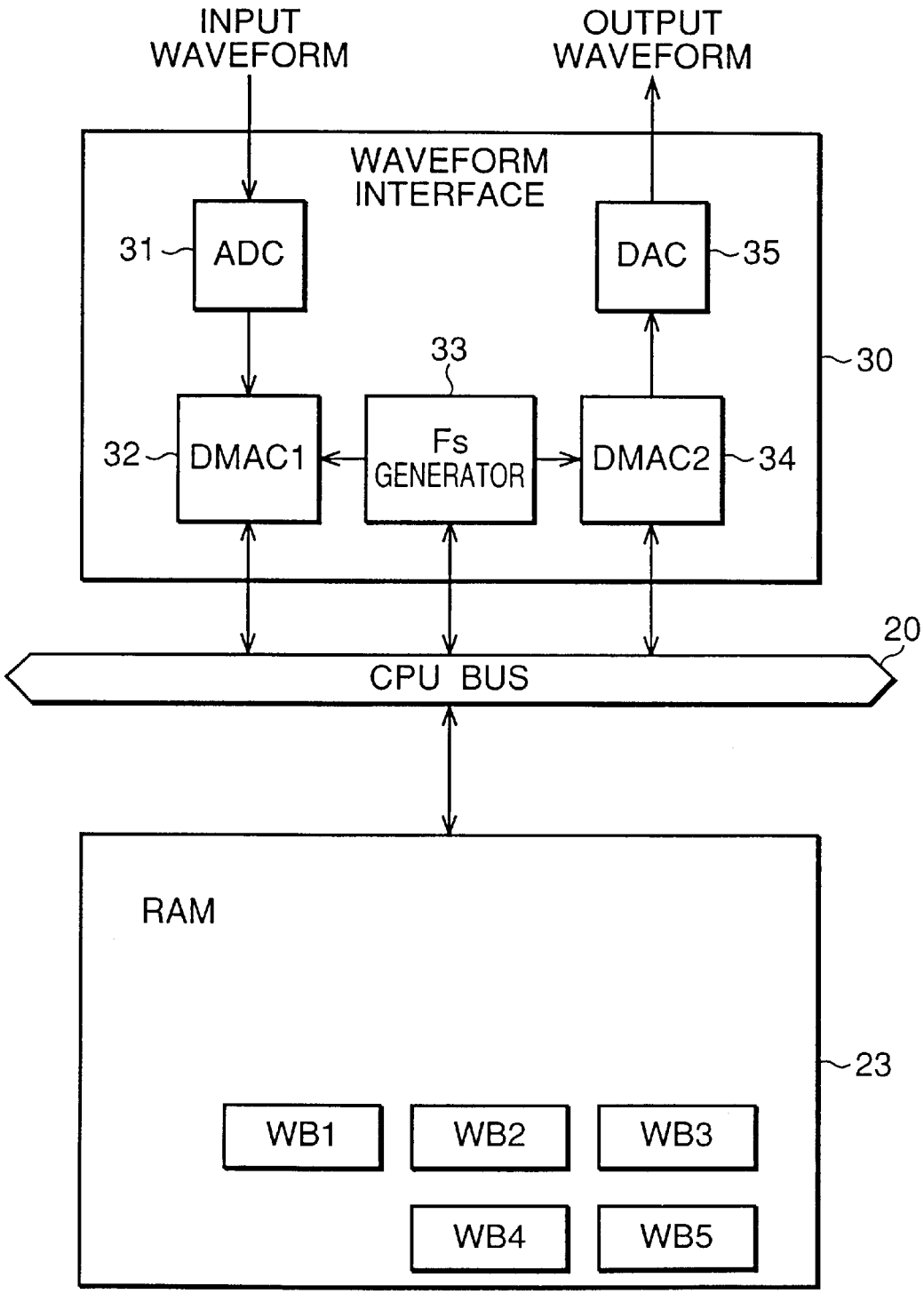
FIG. 3 is a block diagram illustrating a detailed configuration of a waveform interface shown in FIG. 2.

FIG. 3 shows details of the configuration of the waveform interface 30 shown in FIG. 2. As shown, the waveform interface 30 has an analog-to-digital converter (ADC) 31 for converting an input analog audio signal supplied from a microphone for example into a digital audio signal, a first direct memory access controller (DMAC1) 32 for writing the digital data supplied from the ADC 31 to the RAM 23 in units of one sample in each sampling period (1/Fs), a second direct memory access controller (DMAC2) 34 for sequentially reading frames of tone waveform data from buffer memories WB1 through WB5 prepared in the RAM 23 in units of one sample in each sampling period (1/Fs), a digital-to-analog converter (DAC) 35 for converting the tone waveform data read by the second direct memory access controller 34 into an analog tone signal, and an Fs generator 33 for generating a sampling pulse having a period of a common sampling frequency Fs to be supplied to the first and second direct memory access controllers 32 and 34. It should be noted that the CODEC 11 shown in FIG. 1 denotes an integrated circuit for implementing the capabilities of the ADC 31 and the DAC 35 of the waveform interface 30.

To the RAM 23, the WAVE processor 4-1 writes tone waveform data. In the shown example, the buffer memories WB1, WB2, WB3, and WB4 each store one complete frame of tone waveform data for example. The buffer memory WB5 stores incomplete tone waveform data for example. The tone waveform data stored in the buffer memories WB1 through WB4 are sequentially read by the second direct memory access controller 34 in units of one sample in every sampling period (1/Fs) with reference to the sampling pulse generated by the Fs generator 33.

Figure 4:
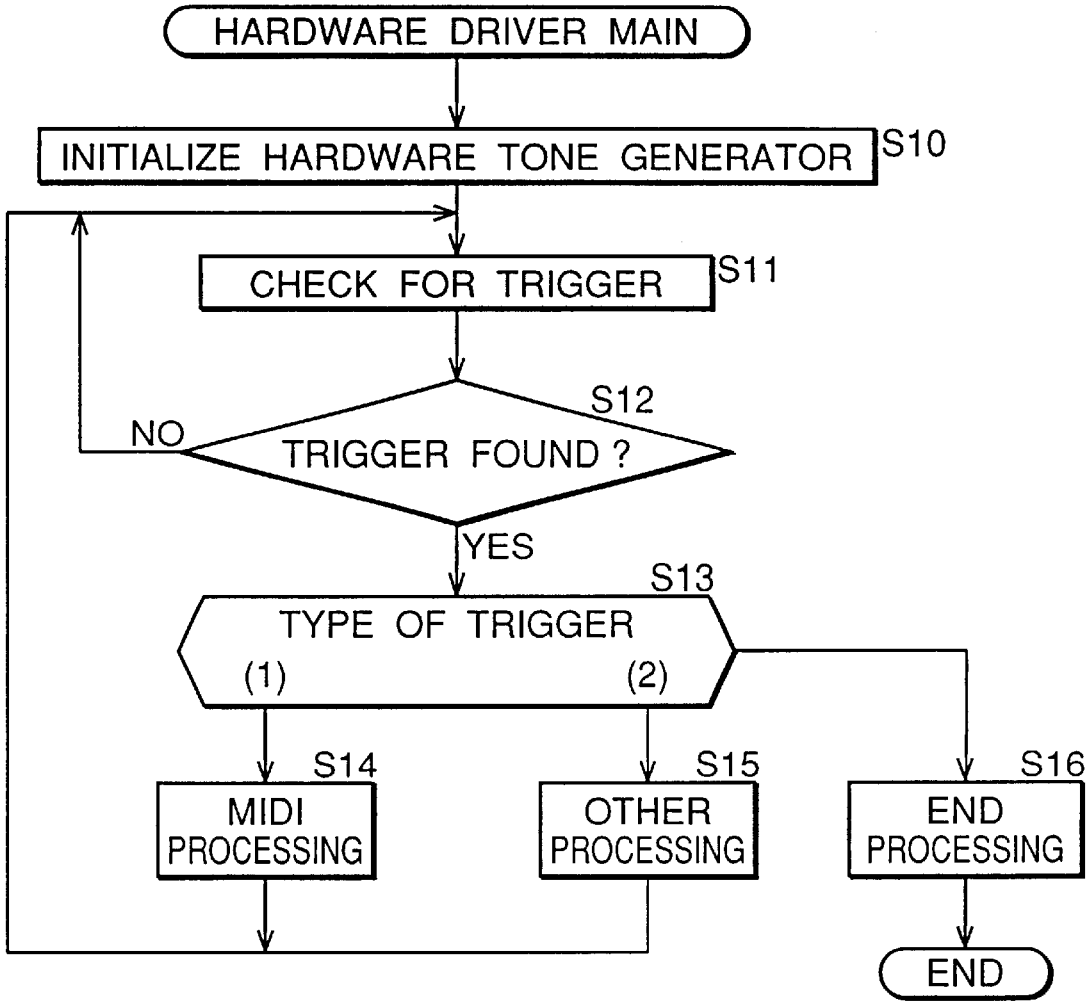
FIG. 4 is a flowchart indicative of a main routine of a MIDI driver for a hardware tone generator.

The following describes the preferred embodiment of the method of controlling a plurality of tone generating drivers based on software with reference to FIGS. 4 and so on. FIG. 4 shows the main routine of the first MIDI driver 5 (hardware tone generator) to be executed by the CPU 21. This main routine (hardware driver main) starts when the OS 2 is booted and if the first MIDI driver 5 (hardware tone generator) is installed on the OS 2. Further, this main routine (hardware driver main) starts when a command to open a driver concerned comes from the integrating driver 3 and the first MIDI driver 5 (hardware tone generator) is registered in the integrating driver 3. When the main routine gets started, the hardware tone generator is initialized in step S10. In this initializing step, the tone generator registers are cleared and the settings of the hardware tone generator 10 is reset.

When the initialization has been completed, the CPU 21 checks for a trigger in step S11. There are three types of triggers that follow:

(1) Supply of a MIDI message through the interface IF10 (MIDI-Out API) of the integrating driver 3 (namely, a MIDI message has been supplied from the music application software 1);

(2) Detection of an input event on the tone generator setting panel displayed on the monitor 28 or a command input event on the keyboard 29; and (3) Inputting of a main routine end command.

In step S12, the CPU 21 checks for any of the above-mentioned triggers. The processing of step S11 is repeated until any of the triggers (1) through (3) is detected. If a trigger is found in step S12, the CPU 21 determines the type of the detected trigger in step S13, and executes a process accordingly. For example, if the trigger (1) is detected, MIDI processing is executed in step S14. If the trigger (2) is detected, other processing is executed in step S15. If the trigger (3) is detected, end processing is executed in step S16.

The MIDI processing to be executed in step S14 includes note-on processing based on a MIDI message note-on event and note-off processing based on a MIDI note-off event. In the note-on processing, a channel is assigned to the hardware tone generator according to the input of a note-on event, a tone parameter corresponding to the inputted note-on event is set to a register of the assigned channel, and a note-on command is issued to this channel. The channel starts generating of a music tone based on the tone parameter. The tone parameter to be set is determined according to the timbre selected for a performance part and the pitch and velocity specified in a note-on event. In the note-off processing, a channel generating a tone corresponding to the note-off event is detected from among the hardware tone generator channels, and a note-off command is issued to the detected channel. If a program change event is supplied, the timbre selected for a specified performance part is changed to another timbre specified by the program change event.

The other processing to be executed in step S15 includes displaying of the tone generator control panel on the monitor 28, selection of timbres of the hardware tone generator, and controlling of tone parameters. If a timer event is detected, LFO control for imparting vibrato to a tone according to the timer event and envelope control are executed in step S15. When the processing of step S14 or step S15 has been completed, then the routine backs to step S11, whereby the processing operations of steps S11 through S15 are repeated. When the trigger (3) is detected, then, in step S16, predetermined end processing for ending this main routine is executed, upon which the main routine (hardware driver main) comes to an end.

Figure 5:
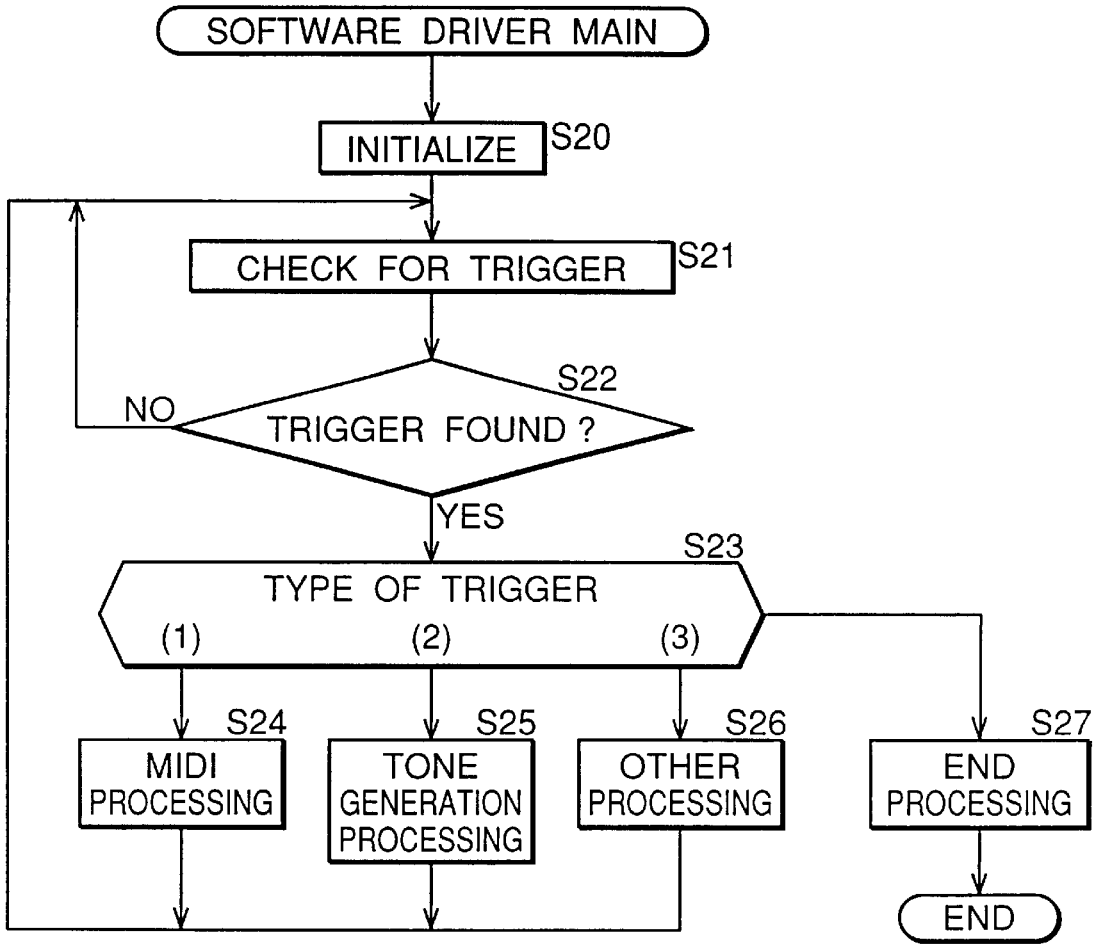
FIG. 5 is a flowchart indicative of a main routine of a MIDI driver constituted by a software tone generator, which is a kind of application software.

FIG. 5 shows a main routine of the second MIDI driver 6 (software tone generator), third MIDI driver 7 (software tone generator), and the fourth MIDI driver 8 (software tone generator) constituted by application programs or software modules to be executed by the CPU 21. This main routine (software driver main) starts when the OS 2 is booted and if one of these MIDI drivers 6–8 is installed on the OS 2. Otherwise, this main routine (software driver main) starts when a command to open each of these drivers 6–8 comes from the integrating driver 3 and if these drivers 6–8 are registered in the integrating driver 3.

When this main routine starts, the second MIDI driver 6 (software tone generator), the third MIDI driver 7 (software tone generator), and/or the fourth MIDI driver 8 (software tone generator) required by the music application software is initialized in step S20. In this initialization, a storage area is allocated on the RAM 23, driver routines are loaded, and registers are cleared.

When the initialization has been completed, the CPU 21 checks for a trigger in step S21. There are four types of triggers that follow:

(1) Supply of a MIDI message through the interface IF11 (MIDI-Out API) or the interface IF12 (MIDI-Out API) or the interface IF2 (MIDI-Out API) installed on the OS 2 (namely, a MIDI message has been supplied from the music application software 1);

(2) In the case of a standard MIDI driver (software tone generator), supply of a trigger indicative of a tone generating timing from the timer 4-2 in the integrated tool library 4, and, in the case of a non-standard MIDI driver (software tone generator), supply of a trigger indicative of an interrupt caused by the OS 2 at a certain time interval;

(3) Detection of an input event on the tone generator setting panel displayed on the monitor 28, a command input event on the keyboard 29, or input of a timer event; and (4) Inputting of a main routine end command.

In step S22, the CPU 21 checks for any of the above-mentioned triggers. The processing of step S21 is repeated until any of the triggers (1) through (4) is detected. If a trigger is found in step S22, the CPU 21 determines the type of the detected trigger in step S23 and executes processing accordingly. For example, if the trigger (1) is detected, MIDI processing is executed in step S24. If the trigger (2) is detected, tone generation processing is executed in step S25. If the trigger (3) is detected, other processing is executed in step S26. If the trigger (4) is detected, end processing is executed in step S27.

If the interface IF11, the interface IF12, and the interface IF2 are to be used, the music application software or the integrating driver 3 must issue a command for opening these interfaces before using the same. For example, when the integrating driver 3 issues a command to open the interface IF11 and the interface IF12 of the standard MIDI drivers 6 and 7 (software tone generator) respectively, these interfaces are opened accordingly as an inlet of MIDI messages. At the same time, the first stream path and the second stream path are opened as an outlet of the tone waveform data generated by these MIDI drivers 6 and 7. When the integrating driver 3 issues a command to open the interface IF2 as an inlet of the MIDI message for the non-standard fourth MIDI driver 8 (software tone generator), this interface IF2 is opened and, at the same time, the interface IF3 is opened as an outlet of the waveform data generated by the non-standard fourth MIDI driver 8. MIDI messages are supplied through the open interfaces IF1, IF12, and IF2 to the tone generating drivers 6–8, thereby causing the trigger (1).

The MIDI processing to be executed in step S24 includes note-on processing based on a MIDI message note-on event and note-off processing based on a MIDI message note-off event. In the note-on processing, a channel is assigned to the software tone generator according to the input of a note-on event, a tone parameter corresponding to the inputted note-on event is set to a register of the assigned channel, and a note-on command is issued to this channel. The channel starts generating of a music tone based on the tone parameter. The tone parameter to be set is determined according to the timbre selected for a performance part and the pitch and velocity specified in a note-on event. In the note-off processing, a channel generating a tone corresponding to the note-off event is detected from among the software tone generator channels, and a note-off command is issued to the detected channel. If a program change event is supplied, the timbre selected for a specified performance part is changed to another timbre specified by the program change event.

In the tone generation processing to be executed in step S25, generation of plural samples of tone waveform data starts when a trigger is supplied from the timer 4-2 or the OS 2. The sampling frequency of the tone waveform data at this moment is set to a predetermined sampling frequency Fs determined by the software tone generator concerned. In the case of the non-standard fourth MIDI driver 8 (software tone generator) that is started alone, the generated tone waveform data is collected on a frame basis. When a frame is completed, the complete frame is passed to the WAVE processor 4-1 through the interface IF3. In the case of the standard second MIDI driver 6 (software tone generator) and third MIDI driver 7 (software tone generator) supervised by the integrating driver 3, the generated tone waveform data is not collected on a frame basis but passed directly to the WAVE processor 4-1 through the first or second stream path.

The other processing to be executed in step S26 includes displaying of the tone generator control panel on the monitor 28, selection of timbres of the software tone generator, and controlling of tone parameters. If a timer event is detected, LFO control for imparting vibrato to a tone according to the timer event and envelope control are executed in step S26. When the processing of step S24, step S25, or step S26 has been completed, then the routine backs to step S21, whereby the processing operations of steps S21 through S26 are repeated. When the trigger (4) is detected, then, in step S27, predetermined end processing for ending this main routine is executed, upon which the main routine (software driver main) comes to an end.

Figure 6:
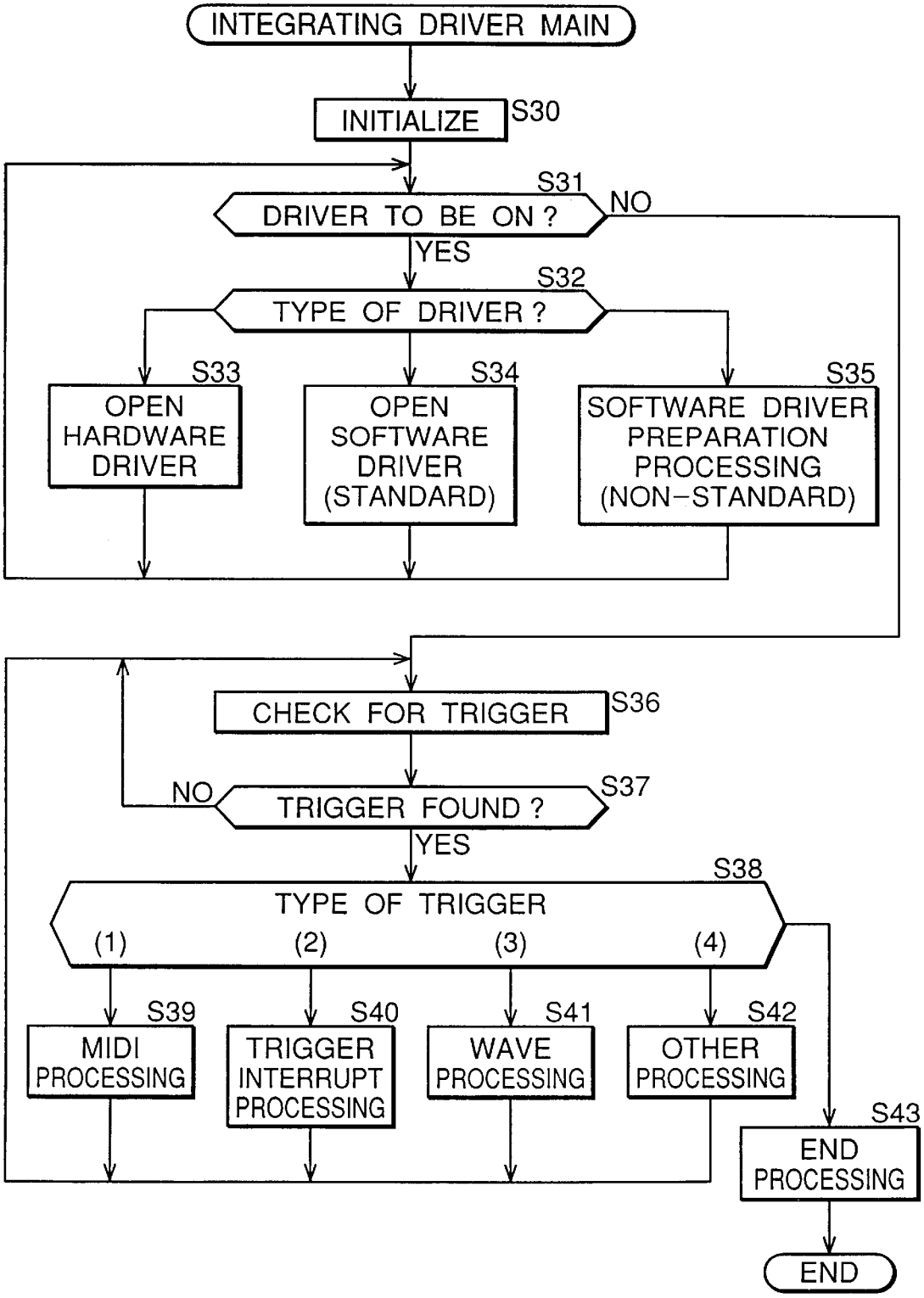
FIG. 6 is a flowchart indicative of a main routine of an integrating driver.

FIG. 6 shows a main routine of the integrating driver (integrating driver main) to be executed by the CPU 21. As described, the integrating driver 3 is installed on the OS 2 as a MIDI driver. Therefore, this main routine starts when the OS 2 is booted. When the main routine starts, initialization is executed in step S30. In step S31, the CPU 21 determines a MIDI driver to be turned on. A MIDI driver required by the music application software 1 is opened or the MIDI driver started last time is opened. If a MIDI driver to be opened is found, MIDI driver open processing is executed in step S32.

In step S32, the CPU 21 determines the type of a MIDI driver to be opened. The MIDI driver having the determined type is opened. For example, if the driver type is found a standard MIDI driver of a hardware tone generator in step S32, the first MIDI driver 5 (hardware tone generator) is searched in step S33 and the processing for opening the same is executed (refer to FIG. 4). If the driver type is found a standard MIDI driver of software tone generator in step S32, the second MIDI driver 6 (software tone generator) and the third MIDI driver 7 (software tone generator) are searched and the processing for opening them is executed (refer to FIG. 5) in step S34. If the driver type is found a non-standard MIDI driver of software tone generator, the fourth MIDI driver 8 (software tone generator) is searched and the preparations for using the same are made in step S35. It should be noted that, when opening each MIDI driver, the corresponding interface IF10, IF11, IF12, or IF2 may also be opened.

When the processing operations of steps S31 through S35 have been executed repeatedly, all or the necessary MIDI drivers are opened. Therefore, decision is NO in step S31 in this case. In step S36, the CPU 21 checks for a trigger. There are five types of triggers that follow:

(1) Supply of a MIDI message through the interface IF1 (MIDI-Out API) installed on the OS 2 (namely, a MIDI message has been supplied from the music application software 1);

(2) Causing an interrupt to transmitting a trigger to the timer 4-2 of the integrated tool library 4;

(3) Reception of tone waveform data generated by a MIDI driver;

(4) Detection of an input event on the tone generator setting panel displayed on the monitor 28 and a command input event on the keyboard 29; and (5) Inputting of a main routine end command.

In step S36, the CPU 21 checks for a trigger. The processing of step S36 is executed repeatedly until any of the triggers (1) through (5) is detected. If a trigger is found in step S37, the CPU 21 determines the type of the trigger and executes processing accordingly. For example, if the trigger (1) is detected, MIDI processing is executed in step S39. If the trigger (2) is detected, trigger interrupt processing is executed in step S40. If the trigger (3) is detected, WAVE processing is executed in step S41. If the trigger (4) is detected, other processing is executed in step S42. If the trigger (5) is detected, end processing is executed in step S43. Meanwhile, if the interface IF1 is to be used, the music application software 1 must issue a command for opening this interface IF1 before use. In addition, when the interface IF1 has been opened, the integrating driver 3 issues a command for opening the interfaces IF1, IF12, and IF2 as the inlet of MIDI messages transferred from the interface IF1. Through the open interface IF1, the MIDI messages are inputted in the integrating driver 3, thereby causing the trigger (1).

Figure 8:
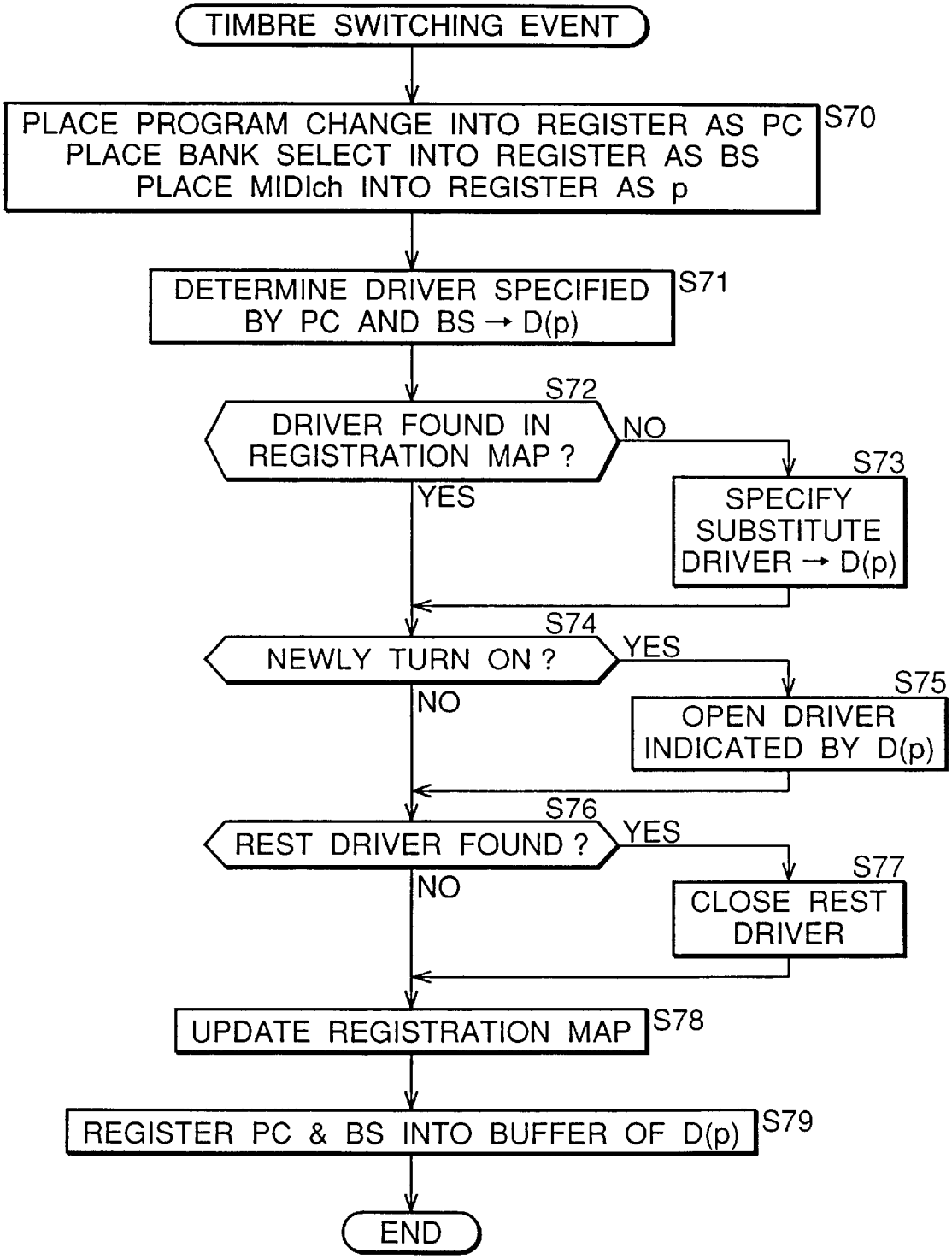
FIG. 8 is a flowchart indicative of timbre switching event processing to be executed in MIDI processing.
Figure 9:
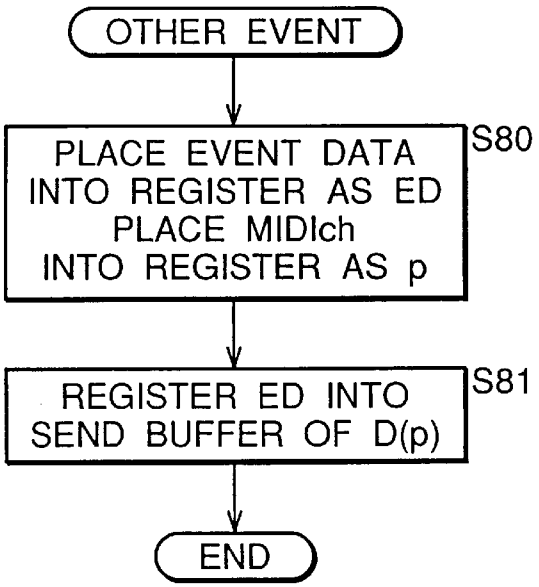
FIG. 9 is a flowchart indicative of other event processing to be executed in MIDI processing.
Figure 10:
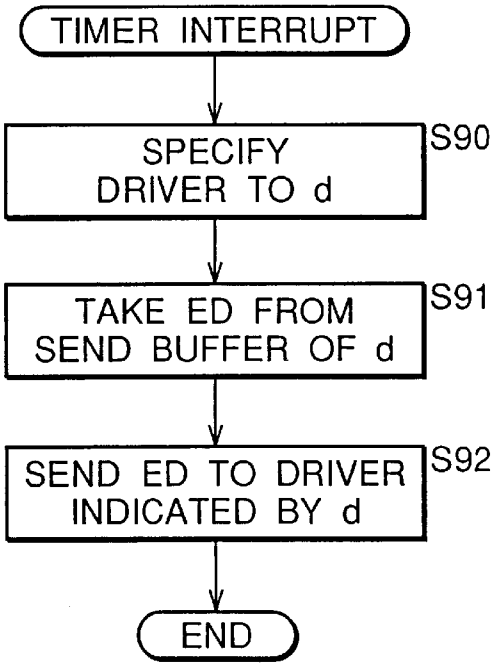
FIG. 10 is a flowchart indicative of timer interrupt processing to be executed in MIDI processing.

In the MIDI processing to be executed in step S39, when a timbre switching event included in a MIDI message such as program change is supplied, timbre switching event processing shown in FIG. 8 is started and executed. When a note-on event or note-off event included in a MIDI message is supplied, other event processing shown in FIG. 9 is executed. In the integrating driver 3, the supplied MIDI messages are allocated and distributed to the specified MIDI drivers. When the time comes to send the event data included in a MIDI message in the distribution processing, timer interrupt processing shown in FIG. 10 is caused and processed.

When program change or bank select is supplied with a MIDI message, the timbre switching event processing shown in FIG. 8 is started. In step S70, the program change included in the MIDI message is inputted into a register as PC, the bank select included in the MIDI message is inputted into a register as BS, and MIDI channel number (MIDIch) included in the program change and the bank select is inputted into a register as p. In step S71, the MIDI driver corresponding to a timbre specified on a timbre map is determined based on the program change PC and the bank select BS. The name of the determined MIDI driver is inputted into a register as D(p). The timbre map stores information about optimum tone generators (namely, optimum MIDI drivers) for the timbres specified by the program change PC and the bank select BS and substitute tone generators (namely, substitute MIDI drivers) to be used if no optimum tone generator is available. Consequently, if there is no software tone generator corresponding to a specified timbre, another software tone generator or a hardware tone generator can be used as a substitute tone generator. It should be noted that 16 MIDI channels of data D(p) store the names of MIDI drivers to be used for generating the tones of parts.

In step S72, the CPU 21 checks the MIDI drivers registered in the integrating driver 3 for the MIDI driver D(p). If the MIDI driver D(p) is found as registered to the integrating driver 3, the decision is Yes in step S72 and the processing goes to step S74. If the MIDI driver D(p) is not found as registered, the decision is No in step S72 and the processing goes to step S73. In step S73, a MIDI driver substituting the MIDI driver D(p) not registered is specified and the name of the substitute MIDI driver is inputted into the register as D(p). In step S74, the CPU 21 determines whether the MIDI driver is to be newly turned on provided that the MIDI driver D(p) has not been turned on. If the MIDI driver having the driver name D(p) held in the register is not opened, the decision is Yes in step S74 and the processing goes to step S75. In step S75, the MIDI driver D(p) is opened and the processing goes to step S76. If the MIDI driver D(p) is found open, step S75 is skipped and the processing goes to step S76.

In step S76, the CPU 21 checks the open MIDI drivers not in use. If a rest MIDI driver not in use is found, this rest MIDI driver is closed in step S77 and the processing goes to step S78. Because the MIDI drivers installed on the OS 2 cannot be closed, the rest MIDI drivers except for the MIDI drivers installed on the OS 2 are closed in step S77. If no rest MIDI driver is found, then, in step S78, the data indicative of the operating or stopped state of the MIDI drivers in the MIDI driver registration map is updated according to the results of the processing of steps S72 through S77. In step S79, the contents of the program change PC and the bank select BS held in the register are written to a send buffer assigned to the MIDI driver D(p), upon which the timbre switching event processing comes to an end. Consequently, the user can switch MIDI drivers based on the program change and bank select processing even during the music performance and open only the MIDI drivers in use, thereby enhancing the usage efficiency of the RAM 23.

If a MIDI message other than a timbre switching event message is supplied in the MIDI processing of step S39, the other event processing in the MIDI processing shown in FIG. 9 starts. In step S80, the event data included in the MIDI message is inputted into a register as ED and the MIDI channel (MIDIch) number of that event data is inputted into a register as p. The MIDI message other than a timbre switching event message includes a note-on message, a note-off message, a pitch bend message, and an after-touch message. In step S81, the event data ED is written to a send buffer of the MIDI driver D(p) corresponding to the MIDI channel number p, upon which the other event processing comes to an end.

After the program change PC, bank select BS, and event data ED have been written to the send buffer of the MIDI driver D(p) set in the timbre switching event processing and other event processing, the data stored in the send buffer are delayed by an offset and then sent to the MIDI driver D(p). The offset is determined based on a computation delay time from supplying the data to the MIDI driver D(p) that has been set to the outputting of a corresponding tone waveform. In order to match the timings with each other of the tone waveform data outputted from a plurality of MIDI drivers, a MIDI driver having a relatively long computation delay time receives the performance data in a relatively short time (therefore the send delay time or offset in the send buffer is short) and vice versa. A timer interrupt is caused between a time when the data are stored in the send buffer and another time when the delay time or offset time set to the corresponding MIDI driver D(p) lapses.

When the timer interrupt is caused, the timer interrupt processing shown in FIG. 10 starts, thereby setting the MIDI driver name specified by the timer interrupt to a register d in step S90. In step S91, the delayed event data ED is taken from the send buffer assigned to the MIDI driver d. In step S92, this event data ED is sent to the MIDI driver d. In the MIDI processing operations of step S39, the MIDI messages to be inputted are written to the send buffers provided for the MIDI drivers and then sent to the corresponding MIDI drivers by the timer interrupt processing. Consequently, the MIDI messages can be distributed to the MIDI drivers in time. In doing so, each piece of data to be written to the send buffer is delayed by a delay time set to that send buffer before being sent, thereby eliminating the difference in timing between the pieces of tone waveform data of the MIDI drivers due to the difference between the computation delay times among the MIDI drivers.

Figure 11:
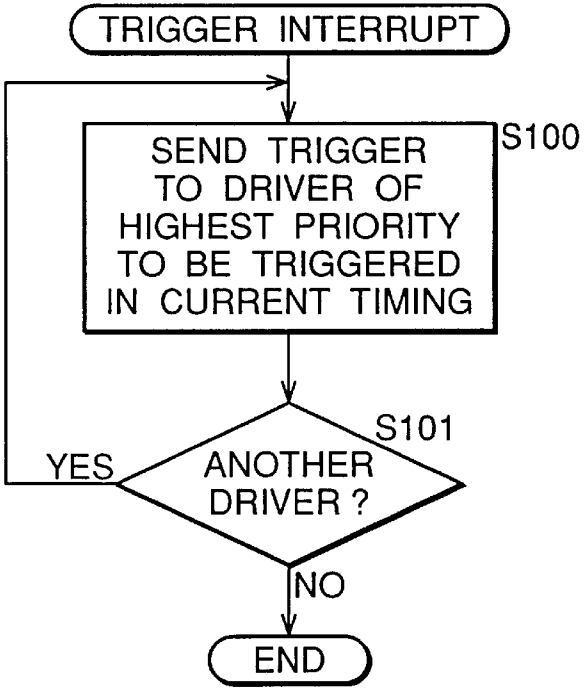
FIG. 11 is a flowchart indicative of trigger interrupt processing to be executed in WAVE processing.

Now, returning to the main routine of the integrating driver 3 shown in FIG. 6, when a trigger interrupt for sending a trigger to the timer 4-2 of the integrated tool library 4 is caused, the trigger interrupt processing starts in step S40. When the trigger interrupt processing has started, the trigger is sent to a standard MIDI driver (software tone generator). The standard MIDI driver is triggered when the trigger interrupt is caused in step S100 of FIG. 11. The triggered MIDI driver should have the highest priority among the tone generating drivers registered to the integrating driver 3. In this case, the MIDI driver having the highest priority is that generates tone waveform data least recently among the plurality of MIDI drivers (software tone generator). If there are two or more MIDI drivers having the approximately same degree of delay, the MIDI driver assigned with the most significant part (for example, solo part) is given the highest priority.

In step S101, the CPU 21 determines whether to send the trigger to other MIDI drivers with that timing based on the state in which the tone waveform data is generated by these MIDI drivers at that time and based on the usage ratio of the CPU 21 including other applications. If the trigger is to be sent to other MIDI drivers, then the routine backs to step S100, and the trigger is sent to the MIDI driver having the highest priority at that moment. In step S101, if the tone waveform data have been sufficiently generated by the MIDI drivers (software tone generator), the CPU 21 determines that no trigger is to be sent, upon which this trigger interrupt processing comes to an end. Even if not sufficient, when another application must be executed before, the CPU 21 determines that no trigger is to be sent, upon which this trigger interrupt processing comes to an end. It should be noted that the trigger interrupt processing is called every 10 ms, for example.

Figure 12:
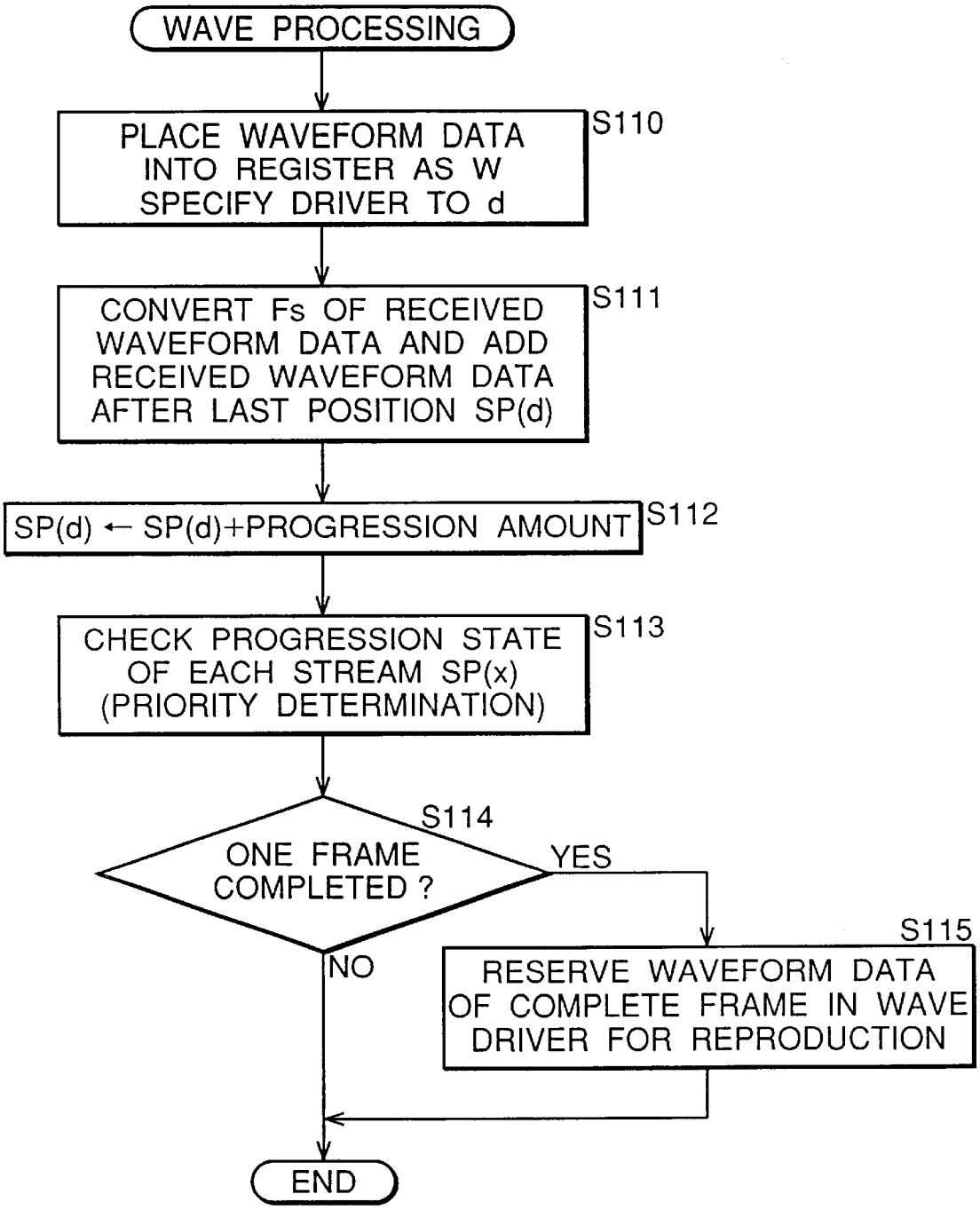
FIG. 12 is a flowchart indicative of a WAVE operation to be executed in WAVE processing.
Figure 13:
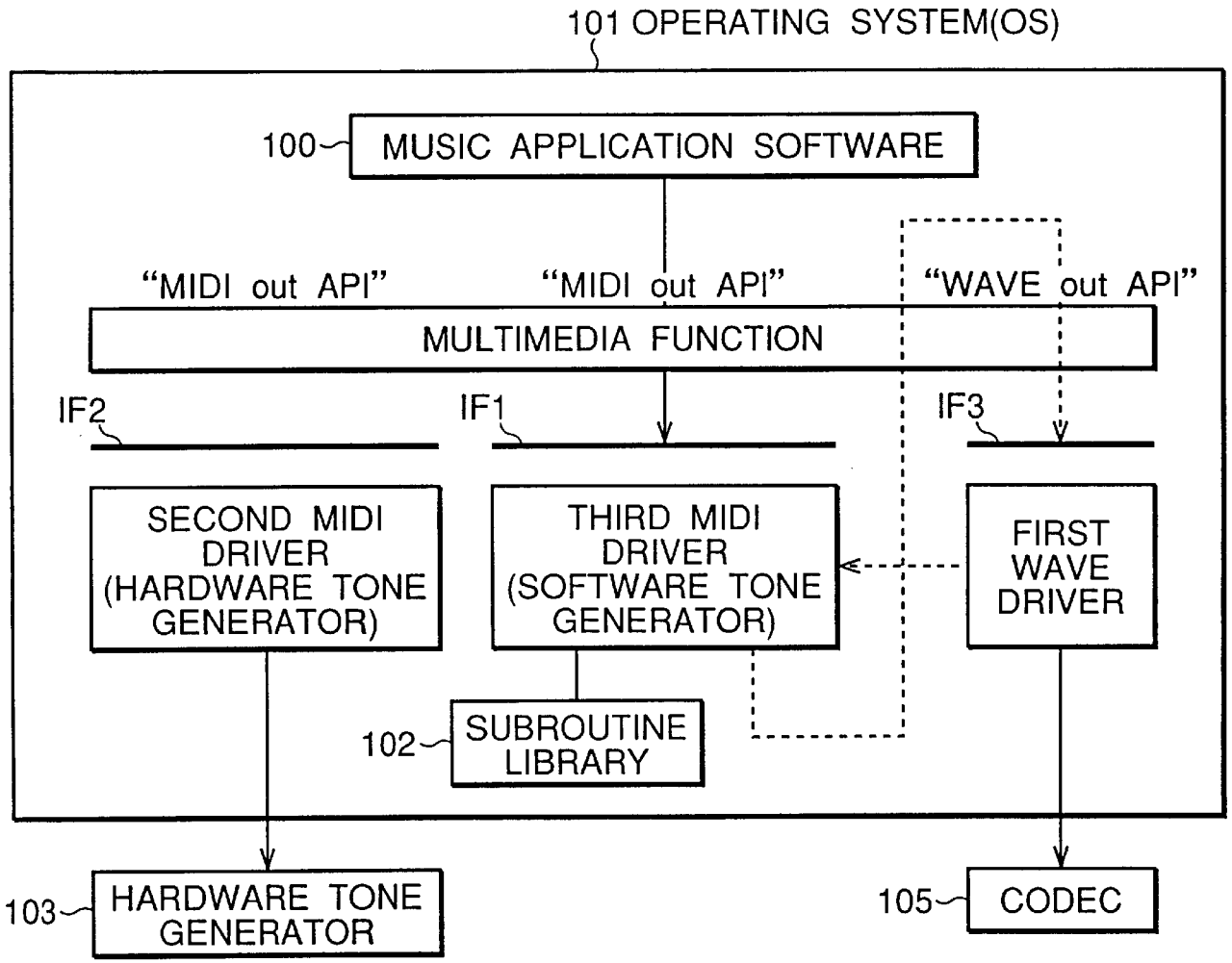
FIG. 13 is a block diagram illustrating a software structure in a related-art tone generating system.

Returning to the main routine shown in FIG. 6 of the integrating driver 3, if the integrating driver 3 has received the tone waveform data generated by a MIDI driver, then, in step S41, the WAVE processing starts. If the MIDI driver is a standard software tone generator, the integrating driver 3 receives the tone waveform data through the first and second stream paths. If the MIDI driver is a non-standard software tone generator, the integrating driver 3 receives the tone waveform data through the interface IF3. When the WAVE processing starts as shown in FIG. 12, the tone waveform data received in step S110 is put in a register as W and the name of the specified MIDI driver that has generated the tone waveform data is put in a register as d. In step S111, if the sampling frequency of the received tone waveform data is found different from a predetermined common sampling frequency Fs, the different specific sampling frequency is converted into the predetermined common sampling frequency Fs. Further, the tone waveform data received this time is added to the tone waveform data already received from other MIDI drivers.

This addition is executed by adding the tone waveform data received this time to the tone waveform data previously received after its position SP(d). Namely, If the last position in the buffer memory of the tone waveform data previously generated by the MIDI driver concerned is SP(d), the tone waveform data received this time is written to the buffer memory to a position after the position SP(d). If the tone waveform data generated by another MIDI driver has already been written to the position after the position SP(d), the tone waveform data received this time is added to the tone waveform data already written and the result is written to that position after the position SP(d). Thus, the tone waveform data generated by two or more MIDI drivers can be mixed together.

In step S112, the progression amount of the tone waveform data received this time is added to the last position SP(d) of the tone waveform data previously generated by the MIDI driver concerned, the result of the addition providing the updated last position SP(d) of the new tone waveform data in the MIDI driver d. It should be noted that the last position SP(d) of tone waveform data is provided for each MIDI driver and the above-mentioned addition processing is executed for each MIDI driver. When the processing of step S112 has been completed, the CPU 21 checks the progression state of each data stream based on the last position SP(d) of the tone waveform data stored in the buffer memory in step S113. This check is made to determine the priority of a trigger given selectively to MIDI drivers. The slower the generation of tone waveform data by a lagging MIDI driver, the higher the priority of sending a trigger to that lagging MIDI driver. Consequently, in the above-mentioned trigger interrupt processing, a trigger is preferentially sent to a lagging MIDI driver of which generation of tone waveform data is being delayed. It should be noted that the processing of step S113 is executed only on the standard MIDI drivers (software tone generator).

In step S114, the CPU 21 determines whether one frame of tone waveform data has been generated in each MIDI driver. If one frame of tone waveform data is generated, the processing goes to step S115. In step S115, the completed one frame of tone waveform data is passed to the WAVE driver through the interface IF4 and reserved for reproduction. If one frame of tone waveform data is not yet completely generated, the WAVE processing ends at that point. In this case, next piece of tone waveform data is received and the WAVE processing restarts to complete one frame of tone waveform data. Until one frame of tone waveform data is completed, the processing of step S115 is skipped. It should be noted that the tone waveform data reserved in the WAVE driver for reproduction is read from the buffer memory in every sampling period (1/Fs) for reproduction.

Returning to the main routine shown in FIG. 6 of the integrating driver 3, if an input event on the tone generator setting panel displayed on the monitor 28 or a command input event from the keyboard 29 is detected, the other processing starts in step S42. In the other processing, the MIDI driver registration shown in FIG. 7A and the MIDI driver deletion shown in FIG. 7B are executed. In this case, when the registration button is clicked on the MIDI driver registration/deletion panel shown on the monitor 28, the registration processing starts and a MIDI driver to be registered is specified in step S50. This MIDI driver specification is executed by clicking the name of a MIDI driver to be registered on the displayed panel for example. In step S51, the specified MIDI driver is entered in a registration map.

The registration map is constituted by the number of registered MIDI drivers and by the data about registered MIDI drivers such as first driver data, second driver data, third driver data, and so on as shown in FIG. 7C. The MIDI driver data include the address of a MIDI driver program loaded in the RAM 23, the operating/stopped state, a trigger period, a sampling frequency, and a computation delay time (delay amount) of tone waveform data. It should be noted that no trigger period is included for the MIDI drivers for hardware tone generator. The trigger period data is used to check the tone waveform data generation state of each MIDI driver (software tone generator) in the above-mentioned trigger interrupt processing. To be more specific, if the amount of tone waveform data to be generated at that point after the last position SP(d) is smaller than the amount equivalent to the trigger period, that MIDI driver need not be triggered. The computation delay time of tone waveform data is recorded for use in adjusting the delay of the system with the slowest MIDI driver. As described, the computation delay time is used to control the offset time of the event data ED in the send buffer corresponding to each MIDI driver.

Returning to the registration processing, when the processing of step S51 is completed, the computation delay time (delay amount) of the tone waveform data of the registered MIDI driver is detected and the detected delay amount is written to the registration map in step S52. It should be noted that the computation delay time is detected by sending a test note-on event to each MIDI driver and by measuring a time at which the response to that test note-on event appears in the tone waveform data generated in each MIDI driver. In step S53, the system delay amount is set to the greatest one of the delay amounts of all MIDI drivers listed in the registration map, upon which the registration processing comes to an end. The difference between the system delay amount and the computation delay time of each MIDI driver determines the send offset time in the send buffer of each MIDI driver.

When the deletion button is clicked on the MIDI driver registration/deletion panel displayed on the monitor 28, the deletion processing shown in FIG. 7B starts. In step S60, a MIDI driver to be deleted is specified. This MIDI driver specification is made by clicking the name of the MIDI driver displayed on the panel for example. In step S61, the specified MIDI driver is deleted from the registration map, upon which the deletion processing comes to an end. If the MIDI driver to be deleted from the registration map is operating, the corresponding interface and the stream path are closed. Further, if that MIDI driver has been opened by the integrating driver 3, that MIDI driver is also closed. Thus, the main routine shown in FIG. 6 of the integrating driver 3 has been executed.

In the above-mentioned preferred embodiment of the invention, the MIDI drivers not used in any part are closed. These MIDI drivers may not be always closed. Leaving these MIDI drivers open allows prompt switching between active ones and rest ones. In the WAVE processor of the above-mentioned preferred embodiment of the invention, the generated tone waveform data is passed to a WAVE driver through the interface IF4 provided by means of the multimedia function of the OS 2. Alternatively, the generated tone waveform data may be passed through an interface especially provided on the WAVE driver without using the multimedia function.

The format of event data in a MIDI message may be any of "event plus relative time" representing a performance event occurrence time in a time from the last event, "event plus absolute time" representing a performance event occurrence time in an absolute time in a piece of music or a bar, "pitch (rest) plus note length" representing performance data in pitch and note length or rest and rest length, and "bear format" in which memory areas are allocated for minimum performance resolutions and a performance event is stored in an allocated memory area corresponding to a time at which the performance event occurs. Further, event data may have a format in which the data of two or more channels coexist or a format in which the data of each channel is stored on a separate area.

Meanwhile, as described before, the hard disk 26 and the removable disk 27 store various programs and data. If the ROM 22 does not store the program for controlling a plurality of tone generator drivers, this program may be stored in the hard disk 26 or the removable disk 27. The stored program is then loaded into the RAM 23 to make the CPU 21 execute the same process as that executed when the program is stored in the ROM 22. This facilitates addition and upgrading of the control program.

Alternatively, a CD-ROM (Compact Disc ROM) drive may be attached to the system, in which the control program stored on the CD-ROM is later stored on the hard disk 26 or the removable disk 27. This also facilitates new installation and upgrading of the control program. It will be apparent that the CD-ROM drive may be replaced with a floppy disk drive, a magneto-optical (MO) disk drive, or the like.

Moreover, adding a communication interface to the hardware configuration associated with the invention allows the hardware configuration to connect to communication networks such as a LAN, the Internet, and a telephone network through the communication interface, whereby the hardware configuration is connected to a remote server computer. Consequently, if the control program and various data are not stored in the local hard disk 26 and the removable disk 27, the control program and various data can be downloaded from the remote server computer. In this case, the hardware configuration associated with the invention, which is a client of the server computer, sends a command to request the server computer for the downloading of the control program and various data through the communication interface and the communication network. Receiving the command, the server computer distributes the requested control program and various data to the hardware configuration associated with the invention through the communication network. Receiving the distributed control program and various data, the hardware configuration stores the same on a local storage device such as the hard disk 26 or the removable disk 27.

As described and according to the invention, there is provided a method of controlling a plurality of tone generating drivers, in which a program for controlling a plurality of tone generating drivers is installed on the operating system, thereby placing an integrating driver below an interface (MIDI-Out API) for transferring MIDI messages prepared on the operating system and an interface (WAVE-Out API) for transferring tone waveform data. Standard MIDI drivers can be registered in the integrating driver to make the registered MIDI drivers available. This novel constitution eliminates the need for restarting the system after the installation on the operating system, thereby significantly enhancing ease of use when using any of the standard MIDI drivers.

Moreover, the integrating driver can switch the MIDI drivers registered in the integrating driver by use of part selecting information (program change and bank select) included in a MIDI message received through an interface (MIDI-Out API). This novel constitution allows the system to dynamically switch MIDI drivers during the music performance.

Further, in the standard MIDI drivers, tone waveform data generated without executing time control on the same is sent to the integrating driver through stream paths. In addition, the integrating driver adds together the pieces of tone waveform data received from two or more MIDI drivers while executing time control on these tone waveform data, thereby forming the resultant tone waveform data into one frame. This novel constitution makes it unnecessary for each MIDI driver to execute time control individually on tone waveform data, thereby significantly mitigating the CPU load.

Still further, although the integrating driver can supervise two or more MIDI drivers at a time, the integrating driver may only adopt one WAVE driver for the destination of tone waveform data. This novel constitution prevents the WAVE drivers from shortage.

Yet further, tone waveform data can be generated by not only a standard MIDI driver but also a non-standard MIDI driver. Consequently, the tone waveform data of various parts can be generated by MIDI drivers having various properties.

As many apparently different embodiments of this invention may be made without departing from the spirit and scope thereof, it is to be understood that the invention is not limited to the specific embodiments thereof except as defined in the appended claims.

What is claimed is:

1. A method of controlling a plurality of tone generating drivers by an integrating driver installed in an operating system for generating music tones according to performance data created by a music application software, the method comprising the steps of:

inputting the performance data created by the music application software to the integrating driver through an application program interface provided by the operating system;

distributing the performance data from the integrating driver to one or more of the tone generating drivers provisionally registered to the integrating driver;

operating the registered tone generating driver to generate waveform data of a music tone at a specific sampling frequency based on the distributed performance data;

streaming the waveform data from the registered tone generating driver to the integrating driver;

converting the specific sampling frequency of the streamed waveform data into a common sampling frequency by the integrating driver;

mixing the waveform data of the common sampling frequency to other waveform data streamed from other tone generating driver while synchronizing progression of the waveform data with progression of other waveform data; and reproducing the mixed waveform data at the common sampling frequency to output the music tones.

2. The method according to claim 1, wherein the step of reproducing comprises feeding the mixed waveform data through another application program interface provided by the operating system to a wave driver installed in the operating system for reproducing the mixed waveform data at the common sampling frequency.

3. A method of controlling a plurality of tone generator modules by an integrator module for generating music tones according to performance data being created by a music application software and being composed of a plurality of timbre parts, the method comprising the steps of:

registering a plurality of tone generator modules for control by the integrator module such that each registered tone generator module is operable under control by the integrator module to generate waveform data of a music tone in accordance with the performance data;

allocating the timbre parts of the performance data to the registered tone generator modules to establish correspondence between each timbre part and each tone generator module;

distributing each timbre part of the performance data from the integrator module to each tone generator module in accordance with the established correspondence so as to operate the plurality of the tone generator modules concurrently with each other to generate a plurality of waveform data representing a plurality of music tones corresponding to the plurality of the timbre parts; and mixing the plurality of the waveform data with each other to output the music tones in accordance with the performance data.

4. A method of controlling a plurality of tone generator modules by an integrator module for generating music tones according to performance data being created by a music application software and being composed of a plurality of performance parts, the method comprising the steps of:

registering a plurality of tone generator modules for control by the integrator module such that each registered tone generator module can carry out a task of processing the performance data to generate waveform data under control by the integrator module;

probing each tone generator module to detect a time lag of the task from an input timing of the performance data to an output timing of the waveform data;

allocating the performance parts of the performance data to the tone generator modules to establish correspondence between each performance part and each tone generator module;

delivering each performance part of the performance data from the integrator module to each tone generator module in accordance with the established correspondence at a variable input timing;

adjusting the input timings of the performance parts of the performance data so as to compensate for the detected time lags among the tone generator modules, thereby synchronizing the output timings of the waveform data from the tone generator modules; and mixing the waveform data generated by the plurality of the tone generator modules to produce the music tones.

5. A method of controlling a plurality of tone generator modules by an integrator module on an operating system to generate music tones in accordance with performance data being created by a music application software and being composed of parts, the method comprising the steps of:

feeding the performance data created by the music application software to the integrator module through an application program interface provided by the operating system;

registering a plurality of tone generator modules for control by the integrator module, each tone generator module being executable on the operating system to generate waveform data of a music tone according to the performance data;

opening an individual interface dedicated to each of the registered tone generator modules for communication with the integrator module;

allocating the performance data to the tone generator modules on a part by part basis;

delivering each allocated part of the performance data from the integrator module to each tone generator module through the individual interface dedicated to each tone generator module so as to generate the waveform data; and collecting the waveform data generated by the registered tone generator modules to the integrator module and mixing the collected waveform data to generate the music tones.

6. The method according to claim 5, wherein the step of registering comprises registering the tone generator modules including a standard tone generator module and a non-standard tone generator module, the step of opening comprises opening a first individual interface provided by the integrator module independently from the operating system for the standard tone generator module and opening a second individual interface provided by the operating system for the non-standard tone generator module, and the step of delivering comprises delivering the performance data to the standard tone generator module through the first individual interface and delivering the performance data to the non-standard tone generator module through the second individual interface.

7. A method of controlling a plurality of tone generator modules by an integrator module on an operating system for generating music tones according to performance data being created by a music application software and being composed of parts, the method comprising the steps of:

feeding the performance data created by the music application software to the integrator module through an application program interface provided by the operating system;

registering a plurality of tone generator modules for control by the integrator module, each tone generator module being executable on the operating system to generate waveform data of a music tone according to the performance data;

opening a data stream path between the integrator module and each of the registered tone generator modules;

allocating the performance data to the registered tone generator modules on a part by part basis;

delivering each allocated part of the performance data from the integrator module to each tone generator module so as to enable each tone generator module to generate the waveform data; and collecting the waveform data generated by each tone generator module to the integrator module through each data stream path and mixing the collected waveform data to generate the music tones.

8. The method according to claim 7, wherein the step of registering comprises registering the tone generator modules including a standard tone generator module and a non-standard tone generator module, the step of opening comprises opening one data stream path provided by the integrator module independently from the operating system for the standard tone generator module and opening another data stream path in the form of an interface provided by the operating system for the non-standard tone generator module, and the step of collecting comprises collecting the waveform data from the standard tone generator module through said one data stream path and collecting the waveform data from the non-standard tone generator module through said another data stream path.

9. A method of controlling a plurality of tone generator modules by an integrator module on an operating system for generating music tones according to performance data being created by a music application software and being composed of parts, the method comprising the steps of:

feeding the performance data created by the music application software to the integrator module through an application program interface provided by the operating system;

registering a plurality of tone generator modules for control by the integrator module;

allocating the performance data a part by part to the registered tone generator modules and delivering each allocated part of the performance data to each corresponding tone generator modules from the integrator module;

applying triggers individually to the tone generator modules to cause the tone generator modules to progressively generate waveform data corresponding to the allocated parts of the performance data in response to the triggers;

collecting the waveform data generated by the tone generator modules to the integrator module and mixing the collected waveform data to output the music tones;

monitoring progressions in the generation of the waveform data by the tone generator modules to discriminate between lagging one and advancing one of the tone generator modules; and controlling application of the triggers to balance the progression of the generation of the waveform data among the lagging tone generator module and the advancing tone generator module.

10. An apparatus having a processor for operating an integrator module and a plurality of tone generator modules on an operating system to execute a process of generating music tones according to performance data created by a music application software, wherein the process comprises the steps of:

inputting the performance data created by the music application software to the integrator module through an application program interface provided by the operating system;

streaming down the performance data from the integrator module to one or more of the tone gene rator modules provisionally registered to the integrator module;

operating the registered tone generator module to generate waveform data of a music tone at a specific sampling frequency based on the streamed performance data;

streaming up the waveform data from the registered tone generator module to the integrator module;

converting the specific sampling frequency of the streamed waveform data into a common sampling frequency by the integrator module;

mixing the waveform data of the common sampling frequency to other waveform data streamed from other tone generator module while synchronizing progression of the waveform data with progression of other waveform data; and reproducing the mixed waveform data at the common sampling frequency to output the music tones.

11. The apparatus according to claim 10, wherein the step of reproducing comprises feeding the mixed waveform data through another application program interface provided by the operating system to a wave module installed in the operating system for reproducing the mixed waveform data at the common sampling frequency.

12. An apparatus having a processor for operating an integrator module and a plurality of tone generator modules to execute a process of generating music tones according to performance data being created by a music application software and being composed of a plurality of timbre parts, wherein the process comprises the steps of:

registering a plurality of tone generator modules for supervision by the integrator module such that each registered tone generator module is operable under supervision by the integrator module to generate waveform data of a music tone in accordance with the performance data;

allocating the timbre parts of the performance data to the registered tone generator modules to establish correspondence between each timbre part and each tone generator module;

distributing each timbre part of the performance data from the integrator module to each tone generator module in accordance with the established correspondence so as to operate the plurality of the tone generator modules concurrently with each other to generate a plurality of waveform data representing a plurality of music tones corresponding to the plurality of the timbre parts; and mixing the plurality of the waveform data with each other to output the music tones in accordance with the performance data.

13. An apparatus having a processor for operating an integrator module and a plurality of tone generator modules to execute a process of generating music tones according to performance data being created by a music application software and being composed of a plurality of performance parts, wherein the process comprises the steps of:

registering a plurality of tone generator modules for supervision by the integrator module such that each registered tone generator module can carry out a task of processing the performance data to generate waveform data under supervision by the integrator module;

probing each tone generator module to detect a time lag of the task measured from an input timing of the performance data to an output timing of the waveform data;

allocating the performance parts of the performance data to the tone generator modules to establish correspondence between each performance part and each tone generator module;

delivering each performance part of the performance data from the integrator module to each tone generator module in accordance with the established correspondence at a variable input timing;

adjusting the input timings of the performance parts of the performance data so as to compensate for the detected time lags among the tone generator modules, thereby synchronizing the output timings of the waveform data from the tone generator modules; and mixing the waveform data outputted from the plurality of the tone generator modules to produce the music tones.

14. An apparatus having a processor for operating an integrator module and a plurality of tone generator modules on an operating system to execute a process of generating music tones in accordance with performance data being created by a music application software and being composed of parts, wherein the process comprises the steps of:

feeding the performance data created by the music application software to the integrator module through an application program interface provided by the operating system;

registering a plurality of tone generator modules for supervision by the integrator module, each tone generator module being operable on the operating system to generate waveform data of a music tone according to the performance data;

opening an individual interface dedicated to each of the registered tone generator modules for communication with the integrator module;

allocating the performance data to the tone generator modules on a part by part basis;

delivering each allocated part of the performance data from the integrator module to each tone generator module through the individual interface dedicated to each tone generator module so as to generate the waveform data; and collecting the waveform data generated by the registered tone generator modules to the integrator module and mixing the collected waveform data to generate the music tones.

15. The apparatus according to claim 14, wherein the step of registering comprises registering the tone generator modules including a standard tone generator module and a non-standard tone generator module, the step of opening comprises opening a first individual interface provided by the integrator module independently from the operating system for the standard tone generator module and opening a second individual interface provided by the operating system for the non-standard tone generator module, and the step of delivering comprises delivering the performance data to the standard tone generator module through the first individual interface and delivering the performance data to the non-standard tone generator module through the second individual interface.

16. An apparatus having a processor for operating an integrator module and a plurality of tone generator modules on an operating system to execute a process of generating music tones according to performance data being created by a music application software and being composed of parts, wherein the process comprises the steps of:

feeding the performance data created by the music application software to the integrator module through an application program interface provided by the operating system;

registering a plurality of tone generator modules for supervision by the integrator module, each tone generator module being operable on the operating system to generate waveform data of a music tone according to the performance data;

opening a data stream path between the integrator module and each of the registered tone generator modules;

allocating the performance data to the registered tone generator modules on a part by part basis;

delivering each allocated part of the performance data from the integrator module to each tone generator module so as to enable each tone generator module to generate the waveform data; and collecting the waveform data generated by each tone generator module to the integrator module through each data stream path and mixing the collected waveform data to generate the music tones.

17. The apparatus according to claim 16, wherein the step of registering comprises registering the tone generator modules including a standard tone generator module and a non-standard tone generator module, the step of opening comprises opening one data stream path provided by the integrator module independently from the operating system for the standard tone generator module and opening another data stream path in the form of an interface provided by the operating system for the non-standard tone generator module, and the step of collecting comprises collecting the waveform data from the standard tone generator module through said one data stream path and collecting the waveform data from the non-standard tone generator module through said another data stream path.

18. An apparatus having a processor for operating an integrator module and a plurality of tone generator modules on an operating system to execute a process of generating music tones according to performance data being created by a music application software and being composed of parts, wherein the process comprises the steps of:

feeding the performance data created by the music application software to the integrator module through an application program interface provided by the operating system;

registering a plurality of tone generator modules for supervision by the integrator module;

allocating the performance data a part by part to the registered tone generator modules and delivering each allocated part of the performance data to each corresponding tone generator modules from the integrator module;

applying triggers periodically to individual ones of the tone generator modules to cause the tone generator modules to progressively generate waveform data corresponding to the allocated parts of the performance data in response to the triggers;

collecting the waveform data generated by the tone generator modules to the integrator module and mixing the collected waveform data to output the music tones;

monitoring progressions in the generation of the waveform data by the tone generator modules to discriminate between lagging one and advancing one of the tone generator modules; and controlling application of the triggers to balance the progression of the generation of the waveform data among the lagging tone generator module and the advancing tone generator module.

19. A machine readable medium for use in a music apparatus having a processor for operating an integrator module and a plurality of tone generator modules on an operating system, the medium containing instructions executable by the processor to cause the music apparatus to perform a process of generating music tones according to performance data created by a music application software, wherein the process comprises the steps of:

inputting the performance data created by the music application software to the integrator module through an application program interface provided by the operating system;

streaming down the performance data from the integrator module to one or more of the tone generator modules provisionally registered to the integrator module;

operating the registered tone generator module to generate waveform data of a music tone at a specific sampling frequency based on the streamed performance data;

streaming up the waveform data from the registered tone generator module to the integrator module;

converting the specific sampling frequency of the streamed waveform data into a common sampling frequency by the integrator module;

mixing the waveform data of the common sampling frequency to other waveform data streamed from other tone generator module while synchronizing progression of the waveform data with progression of other waveform data; and reproducing the mixed waveform data at the common sampling frequency to output the music tones.

20. The machine readable medium according to claim 19, wherein the step of reproducing comprises feeding the mixed waveform data through another application program interface provided by the operating system to a wave module installed in the operating system for reproducing the mixed waveform data at the common sampling frequency.

21. A machine readable medium for use in a music apparatus having a processor for operating an integrator module and a plurality of tone generator modules, the medium containing instructions executable by the processor to cause the music apparatus to perform a process of generating music tones according to performance data being created by a music application software and being composed of a plurality of timbre parts, wherein the process comprises the steps of:

registering a plurality of tone generator modules for supervision by the integrator module such that each registered tone generator module is operable under supervision by the integrator module to generate waveform data of a music tone in accordance with the performance data;

allocating the timbre parts of the performance data to the registered tone generator modules to establish correspondence between each timbre part and each tone generator module;

distributing each timbre part of the performance data from the integrator module to each tone generator module in accordance with the established correspondence so as to operate the plurality of the tone generator modules concurrently with each other to generate a plurality of waveform data representing a plurality of music tones corresponding to the plurality of the timbre parts; and mixing the plurality of the waveform data with each other to output the music tones in accordance with the performance data.

22. A machine readable medium for use in a music apparatus having a processor for operating an integrator module and a plurality of tone generator modules, the medium containing instructions executable by the processor to cause the music apparatus to perform a process of generating music tones according to performance data being created by a music application software and being composed of a plurality of performance parts, wherein the process comprises the steps of:

registering a plurality of tone generator modules for supervision by the integrator module such that each registered tone generator module can carry out a task of processing the performance data to generate waveform data under supervision by the integrator module;

probing each tone generator module to detect a time lag of the task measured from an input timing of the performance data to an output timing of the waveform data;

allocating the performance parts of the performance data to the tone generator modules to establish correspondence between each performance part and each tone generator module;

delivering each performance part of the performance data from the integrator module to each tone generator module in accordance with the established correspondence at a variable input timing;

adjusting the input timings of the performance parts of the performance data so as to compensate for the detected time lags among the tone generator modules, thereby synchronizing the output timings of the waveform data from the tone generator modules; and mixing the waveform data outputted from the plurality of the tone generator modules to produce the music tones.

23. A machine readable medium for use in a music apparatus having a processor for operating an integrator module and a plurality of tone generator modules on an operating system, the medium containing instructions executable by the processor to cause the music apparatus to perform a process of generating music tones in accordance with performance data being created by a music application software and being composed of parts, wherein the process comprises the steps of:

feeding the performance data created by the music application software to the integrator module through an application program interface provided by the operating system;

registering a plurality of tone generator modules for supervision by the integrator module, each tone generator module being operable on the operating system to generate waveform data of a music tone according to the performance data;

opening an individual interface dedicated to each of the registered tone generator modules for communication with the integrator module;

allocating the performance data to the tone generator modules on a part by part basis;

delivering each allocated part of the performance data from the integrator module to each tone generator module through the individual interface dedicated to each tone generator module so as to generate the waveform data; and collecting the waveform data generated by the registered tone generator modules to the integrator module and mixing the collected waveform data to generate the music tones.

24. The machine readable medium according to claim 23, wherein the step of registering comprises registering the tone generator modules including a standard tone generator module and a non-standard tone generator module, the step of opening comprises opening a first individual interface provided by the integrator module independently from the operating system for the standard tone generator module and opening a second individual interface provided by the operating system for the non-standard tone generator module, and the step of delivering comprises delivering the performance data to the standard tone generator module through the first individual interface and delivering the performance data to the non-standard tone generator module through the second individual interface.

25. A machine readable medium for use in a music apparatus having a processor for operating an integrator module and a plurality of tone generator modules on an operating system, the medium containing instructions executable by the processor to cause the music apparatus to perform a process of generating music tones according to performance data being created by a music application software and being composed of parts, wherein the process comprises the steps of:

feeding the performance data created by the music application software to the integrator module through an application program interface provided by the operating system;

registering a plurality of tone generator modules for supervision by the integrator module, each tone generator module being operable on the operating system to generate waveform data of a music tone according to the performance data;

opening a data stream path between the integrator module and each of the registered tone generator modules;

allocating the performance data to the registered tone generator modules on a part by part basis;

delivering each allocated part of the performance data from the integrator module to each tone generator module so as to enable each tone generator module to generate the waveform data; and collecting the waveform data generated by each tone generator module to the integrator module through each data stream path and mixing the collected waveform data to generate the music tones.

26. The machine readable medium according to claim 25, wherein the step of registering comprises registering the tone generator modules including a standard tone generator module and a non-standard tone generator module, the step of opening comprises opening one data stream path provided by the integrator module independently from the operating system for the standard tone generator module and opening another data stream path in the form of an interface provided by the operating system for the non-standard tone generator module, and the step of collecting comprises collecting the waveform data from the standard tone generator module through said one data stream path and collecting the waveform data from the non-standard tone generator module through said another data stream path.

27. A machine readable medium for use in a music apparatus having a processor for operating an integrator module and a plurality of tone generator modules on an operating system, the medium containing instructions executable by the processor to cause the music apparatus to perform a process of generating music tones according to performance data being created by a music application software and being composed of parts, wherein the process comprises the steps of:

feeding the performance data created by the music application software to the integrator module through an application program interface provided by the operating system;

registering a plurality of tone generator modules for supervision by the integrator module;

allocating the performance data a part by part to the registered tone generator modules and delivering each allocated part of the performance data to each corresponding tone generator modules from the integrator module;

applying triggers periodically to individual ones of the tone generator modules to cause the tone generator modules to progressively generate waveform data corresponding to the allocated parts of the performance data in response to the triggers;

collecting the waveform data generated by the tone generator modules to the integrator module and mixing the collected waveform data to output the music tones;

monitoring progressions in the generation of the waveform data by the tone generator modules to discriminate between lagging one and advancing one of the tone generator modules; and controlling application of the triggers to balance the progression of the generation of the waveform data among the lagging tone generator module and the advancing tone generator module.

* * * * *